US012631099B2

(12) United States Patent
Ibrahim

(10) Patent No.: US 12,631,099 B2
(45) Date of Patent: May 19, 2026

(54) SYSTEM AND METHODS FOR DETERMINING THE EFFECT OF FRACTURE INTERFERENCE ON SHALE WELL PERFORMANCE

(71) Applicant: KING FAHD UNIVERSITY OF PETROLEUM AND MINERALS, Dhahran (SA)

(72) Inventor: Ahmed Farid Ibrahim, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 485 days.

(21) Appl. No.: 18/357,638

(22) Filed: Jul. 24, 2023

(65) Prior Publication Data

US 2024/0076973 A1 Mar. 7, 2024

Related U.S. Application Data

(60) Provisional application No. 63/404,015, filed on Sep. 6, 2022.

(51) Int. Cl.

| | |
|---|---|
| ***E21B 43/26*** | (2006.01) |
| ***E21B 47/06*** | (2012.01) |
| ***E21B 47/10*** | (2012.01) |

(52) U.S. Cl.

CPC ..... *E21B 43/26* (2013.01); *E21B 47/06* (2013.01); *E21B 47/10* (2013.01); *E21B 2200/20* (2020.05)

(58) Field of Classification Search

CPC ..... E21B 43/26; E21B 47/06; E21B 47/10; E21B 2200/20

See application file for complete search history.

(56) References Cited

U.S. PATENT DOCUMENTS 10,400,550 B2 * 9/2019 Gu ..... E21B 43/26
11,308,409 B1 4/2022 Molina Ortiz
(Continued)

FOREIGN PATENT DOCUMENTS

CN 112878977 B 4/2022

OTHER PUBLICATIONS

"P50 (and P90, Mean, Expected and P10)", THEPD: (The Project Definition), https://www.theprojectdefinition.com/p50-p90-mean-expected-p10/, Dec. 13, 2015, 1 page.
(Continued)

*Primary Examiner* — Catherine T. Rastovski
*Assistant Examiner* — Nyla Gavia
(74) *Attorney, Agent, or Firm* — Oblon, McClelland, Maier & Neustadt, L.L.P.

(57) ABSTRACT

A system for hydraulic fracturing in a shale layer of a geological formation is described. The system includes a borehole which extends between surface of geological formation and shale layer, and a horizontal fracturing pipe which extends perpendicularly from borehole into the shale layer. The horizontal fracturing pipe includes a number of periodic perforations. The system includes a pump and a fracturing fluid to be injected by the pump into borehole and horizontal fracturing pipe. The fracturing fluid is injected through periodic perforations and stimulates fractures in shale layer. The system includes a pressure sensor and a fluid meter. The pressure sensor measures pressure of fracturing fluid in horizontal fracturing pipe. A computing device determines the spacing distance of the perforations based on a percentage of interference between the perforation and a net present value of production.

20 Claims, 20 Drawing Sheets

(56) References Cited

U.S. PATENT DOCUMENTS

| | | | | |
|---|---|---|---|---|
| 2007/0272407 | A1 | 11/2007 | Lehman et al. | |
| 2020/0291774 | A1* | 9/2020 | Balan | E21B 49/00 |
| 2020/0386093 | A1 | 12/2020 | Klenner et al. | |
| 2021/0079788 | A1* | 3/2021 | Wang | E21B 49/008 |
| 2022/0215156 | A1 | 7/2022 | Roussel | |

OTHER PUBLICATIONS

"E-M Flowmeter", Century Wireline Services, https://www.centurywirelineservices.com/9722.htm, Tool#: 9722, Part#: 300500, 2018, 7 pages.

* cited by examiner

SYSTEM AND METHODS FOR DETERMINING THE EFFECT OF FRACTURE INTERFERENCE ON SHALE WELL PERFORMANCE

CROSS REFERENCE TO RELATED APPLICATIONS

The present application claims the benefit of priority to U.S. Prov. application Ser. No. 63/404,015, titled "Integrated Workflow to Estimate the Degree of Fracture Interference and Its Effect on Shale Well Performance," filed on Sep. 6, 2022, and incorporated herein by reference in its entirety.

BACKGROUND

Technical Field

The present disclosure is directed to system and methods for determining the effect of fracture interference on shale well performance.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Horizontal drilling and multistage hydraulic fracturing processes are employed in shale formations over the past few years for extraction of fuel and minerals. Various hydraulic fracturing fluid systems that can be used in the fracturing process include cross-linked high viscosity systems, foam-based fluids, and slickwater systems. Cluster spacing (also referred to as fracture spacing) is a crucial factor in shale gas hydraulic fracturing design. A cluster is a group of fractures at a fracturing zone. In the situation of cluster spacings which are too close together, a stimulated reservoir volume may be affected by major fracture interference where the fractures may overlap each other and decrease the hydraulic fracturing treatment efficiency. However, overly large cluster spacing may lead to a large unstimulated reservoir volume in the middle of hydraulic fractures, which may result in poor recovery. In either situation, hydraulic fracturing would be inefficient. Consequently, a well-defined design for cluster spacing is essential to improve the stimulated reservoir volume and increase the fracturing efficiency. For example, a well-defined cluster spacing is essential to create more fractures in a large volume and improve well productivity. Horizontal drilling now allows operators to drill and set pipe for a mile or more horizontally through the same rock formation. Directional drilling contractors use sensors to detect particularly promising rock intervals within the formation and are able to move the drill string up or down, left or right as they drill the horizontal section to target intervals. However, due to high completion costs and production interference, there is a limitation to cluster spacing.

US2020/0291774 A1 describes determination of effective fracture surface-area per cluster of hydraulic fractures of the hydraulically-fractured well by estimating total effective fracture-area associated with a wellbore and estimating the relative distribution of effective fracture surface-area along the wellbore. However, the estimated effective fracture surface-area is the relative distribution of cracking and is not assocated with fracture interference.

US20070272407 A1 describes a fracture model (which is a numerical model) generated from fracture treatment of a well having a naturally fractured formation. A fracture simulator is used to determine efficacy of the well. However, the efficiency may not be reliable due lack of knowledge of the natural fracture. Therefore, none of the prior art references discloses an efficient technique of calculating a percentage of interference and determining the effect of fracture interference as a function of cluster spacing.

Accordingly, there is a need for systems and methods that determine the number of periodic perforations in a horizontal fracturing pipe which maximize a net present value of production which minimizing the percentage of interference between the cluster spacings.

SUMMARY

In an exemplary embodiment, a horizontal fracture field system for hydraulic fracturing in a shale layer of a geological formation is disclosed. The horizontal fracture field system includes a borehole which extends between a surface of the geological formation and the shale layer, a tubing which extends into the borehole between a surface of the geological formation and the shale layer; and a horizontal fracturing pipe connected to the tubing which extends perpendicularly from the borehole into the shale layer, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer. The horizontal fracture field system further includes a pump located at the surface of the geological formation, and a fracturing fluid configured to be injected under pressure by the pump into the borehole and into the horizontal fracturing pipe, wherein the pump is configured to inject the fracturing fluid under pressure through the perforations of the stages to fracture a fracture zone in the shale layer. The horizontal fracture field system further includes a pressure sensor configured to measure the pressure of the fracturing fluid in the horizontal fracturing pipe. The horizontal fracture field system includes a fluid meter configured to measure a volume of a material forced out of the fractures by the fracturing fluid. The horizontal fracture field system includes a computing device connected to the pump, the pressure sensor, and the fluid meter. The computing device includes electrical circuitry, a memory storing program instructions and at least one processor configured to execute program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an estimated fracture surface area of the horizontal fracture field and $A_{Ca}$ represents an actual fracture surface area of the horizontal fracture field; determine a net present value NPV for each spacing distance; and determine the spacing distance which minimizes the percentage of interference PI while maximizing the net present value NPV.

In another exemplary embodiment, a method for building a horizontal fracture field having low cluster interference is disclosed. The method includes determining reservoir properties of a shale layer of a geological formation of interest, and calculating, by a computing device including electrical circuitry, a memory storing program instructions and at least one processor configured to execute the program instructions, an actual fracture surface area ($A_{Ca}$) of the horizontal fracture field, exporting, by the computing device, production data from a predetermined stimulated fracture surface area, conducting, by the computing device, a rate transient analysis (RTA) of the production data to estimate an effective stimulated fracture surface area ($A_{Ce}$) for a given number of periodic perforations in a horizontal fracturing pipe, calculating, by the computing device, a ratio of the effective fracture surface area ($A_{Ce}$) to the actual fracture surface area ($A_{Ca}$), storing, in the memory of the computing device, the ratio of the effective fracture surface area to the actual fracture surface area for the first number of periodic perforations, and iterating, by the computing device, the calculation of the ratio for a second number of periodic perforations, where the second number is greater than the first number by a step amount. The method also includes continuing, by the computing device, to iterate the calculation of the ratio by adding the step amount to each previous number of periodic perforations until the production is less than or equal to a threshold amount, building, by the computing device, a proxy model to estimate a percentage of interference between the fractures as a function of spacing distance between the number of perforations and the formation properties, determining, by the computing device, a net present value (NPV) from the proxy model, estimating, by the computing device, the number of perforations which maximizes the NPV from the proxy model while minimizing the percentage of interference PI from the RTA; installing perforated sections and unperforated sections of the horizontal fracturing pipe in the horizontal fracture field based on the estimated number of perforations; and stimulating the horizontal fracture field by injecting a fracturing fluid under pressure into the horizontal fracturing pipe through the number of perforations.

In yet another exemplary embodiment, a method for hydraulic fracturing in a shale layer of a geological formation is disclosed. The method includes installing a tubing in a borehole which extends between a surface of the geological formation and the shale layer and installing a horizontal fracturing pipe which extends perpendicularly from the borehole into the shale layer, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer. The method further includes installing the tubing in the horizontal fracturing pipe and installing a pump at the surface of the geological formation, wherein the pump is configured to inject a fracturing fluid under pressure into the tubing, wherein the pressure of the fracturing fluid is configured to inject the fracturing fluid through the perforations and stimulate fractures in the shale layer. The method includes installing a pressure sensor at the surface of the geological formation, where the pressure sensor is configured to measure the pressure of the fracturing fluid. The method also includes installing a fluid meter at the surface of the geological formation, wherein the fluid meter is configured to measure a volume of the fracturing fluid injected into the horizontal fracturing pipe or a volume of a material forced out of the borehole by the fracturing fluid, wherein the material is one or more of oil and natural gas. The method includes connecting a computing device to the pump, the pressure sensor and the water meter, wherein the computing device includes electrical circuitry, a memory storing program instructions and at least one processor configured to execute the program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an estimated fracture surface area of the horizontal fracture field and $A_{Ca}$ represents an actual fracture surface area of the horizontal fracture field; determining a net present value NPV for each spacing distance; and determining the spacing distance which minimizes the percentage of interference PI while maximizing the net present value NPV.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
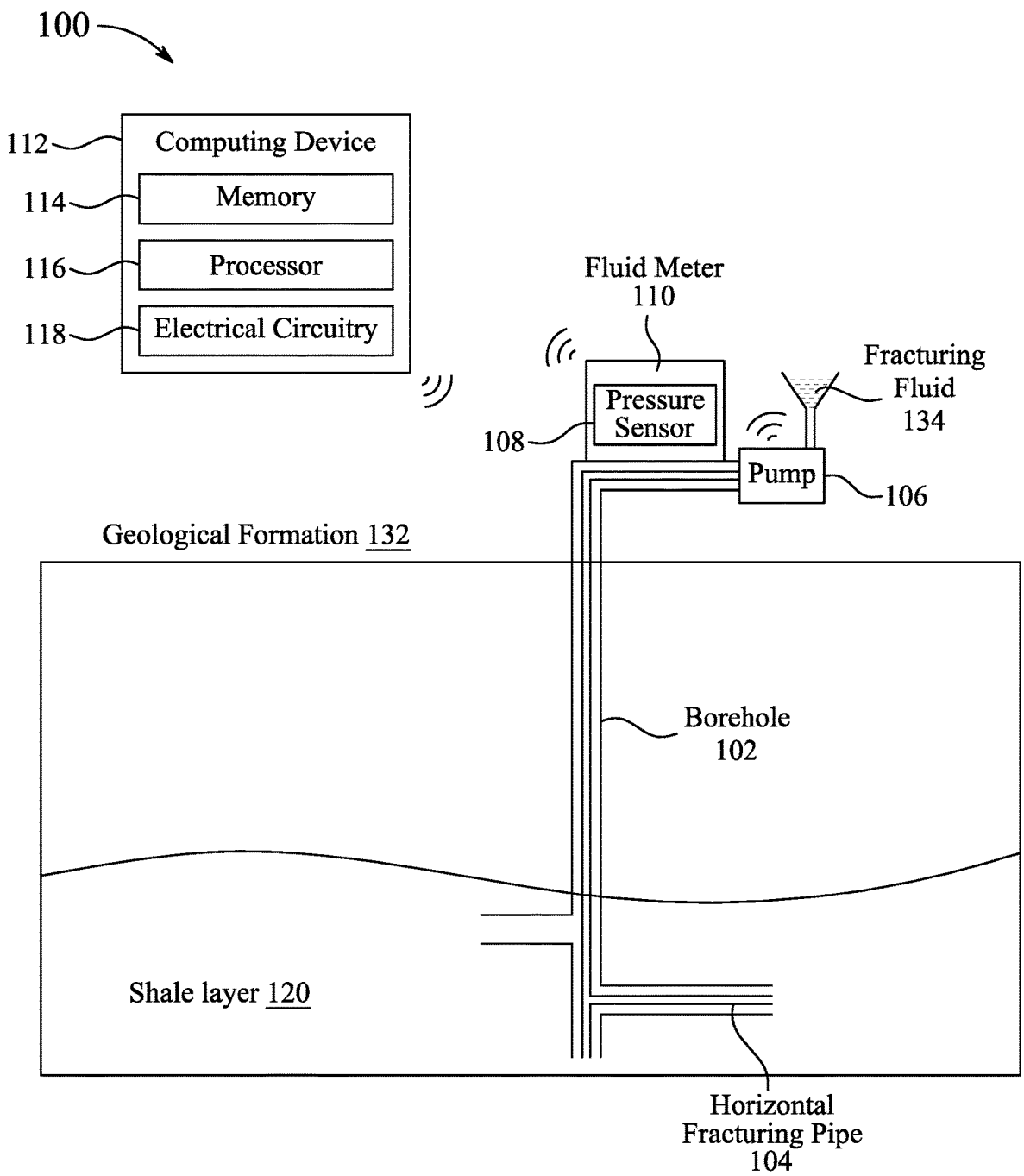
FIG. 1A depicts a horizontal fracture field system for hydraulic fracturing in a shale layer of a geological formation.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Aspects of the present disclosure are directed to system and methods for determining the effect of fracture interference on shale well performance so as to improve oil and gas recovery from a geological formation. Frocking fluid is composed of water, chemicals and sand, and is forcefully injected into the hydrocarbon-containing shale layer. The force of the injections props the shale open, creating cracks and fissures that allow large volumes of hydrocarbons to be extracted.

The borehole of a shale well may have horizontal shaft in which multistage hydraulic fracturing processes are employed through drilling or production tubing to extract hydrocarbons and minerals. Some of the hydraulic fracturing fluids used in the fracturing process include cross-linked high viscosity systems, foam-based fluids, and slickwater systems. Each perforation in a horizontal shaft generates a cluster of fractures at a fracturing zone. When the spacing distance of the clusters are too close together, fracture interference may occur during stimulation of the well. The fractures may overlap each other and decrease the hydraulic fracturing treatment efficiency. However, overly large fracture spacing may lead to a large unstimulated reservoir volume in the middle of hydraulic fractures, which may result in poor recovery. Aspects of the present disclosure provide a method and system for determining cluster spacing which functions to improve the stimulated reservoir volume and increase the fracturing efficiency.

Aspects of the present disclosure include determining the spacing distance between the perforations which yields the highest volume of oil/gas production and determining a number of perforations which are designed to create fractures at the fracture spacings when the well is stimulated by the forceful injection of fracturing fluid through a horizontal fracturing pipe.

A horizontal fracturing pipe may include many components, including valves, packers, liners and pressure sensors as well as pipe regions which are thin and capable of perforation by the fracturing fluid. These thin pipe regions are referred to as perforations in the present disclosure. Each section of fracturing pipe is referred to as a stage. In the present disclosure, the term "horizontal fracturing pipe" is defined as the continuous pipe formed by installing stages of sections of fracturing pipe. The pipe need not be precisely horizontally disposed in a geological formation.

FIG. 1A depicts a horizontal fracture field system 100 for hydraulic fracturing in a shale layer 120 of a geological formation 132. In an example, the geological formation 132 may include a well.

The horizontal fracture field system 100 includes tubing disposed in a borehole 102. The borehole 102 extends between a surface of the geological formation 132 and the shale layer 120. The horizontal fracture field system 100 also includes a horizontal fracturing pipe 104. The horizontal fracturing pipe 104 extends perpendicularly from the borehole 102 into the shale layer 120. The horizontal fracturing pipe 104 is configured to have a number of periodic perforations. In an example, the number of perforations may be denoted by "$N_f$". The horizontal fracturing pipe 104 includes pipe sections which connect together, where each pipe section is configured as one of a pipe section with at least one perforation and an unperforated pipe section. In an example, the type of the horizontal fracturing pipe 104 may be chosen or selected based on the spacing of the perforations.

The horizontal fracture field system 100 further includes a pump 106. The pump 106 is located at the surface of the geological formation 132. The horizontal fracture field system 100 also includes a fracturing fluid 134. The fracturing fluid 134 is injected under pressure by the pump 106 into the borehole 102 through the tubing and into the horizontal fracturing pipe 104. The pump ejects the fracturing fluid 134 at high pressure through the periodic perforations and stimulates fractures in the shale layer 120.

The horizontal fracture field system 100 includes at least one pressure sensor 108. At least one pressure sensor 108 may be located at the surface of the geological formation 132. There may be multiple pressure sensors located at a plurality of locations in the borehole or the horizontal fracturing pipe. The pressure sensor 108 is configured to measure the pressure of the fracturing fluid 134 in the horizontal fracturing pipe 104. The horizontal fracture field system 100 further includes a fluid meter 110. The fluid meter 110 may also be referred to as a flowmeter. The fluid meter 110 is located at the surface of the geological formation 132. The fluid meter 110 is configured to measure the amount of fracturing fluid injected into the tubing and/or a volume of a material forced out of the fractures by the fracturing fluid 134. The volume of material the fractures may include hydrocarbons, such as oil and gas, as well as drilling rock, water and small particulate matter. The fluid meter 110 may measure the volume of material which flows from the borehole per unit time. The fluid meter 110 may include a hollow cylinder through which a portion of material flows. The fluid meter 110 may measure the velocity of the material (or flow rate) exiting the borehole per unit time and calculate the volume of material recovered per unit time from this measurement. There may be multiple fluid meters, pressure sensors and pumps in a borehole and/or the fracturing pipe as is known in the art. For the sake of simplicity, the fluid meter 110, pressure sensor 108 and pump 106 are interpreted as representing these multiple fluid meters, pressure sensors and pumps. In a non-limiting example, the fluid meter may be an E-M Flowmeter, manufactured by Century Wireline Services, Tulsa, Oklahoma, United States of America.

The horizontal fracture field system 100 also includes a computing device 112. The computing device 112 is connected to the pump 106, the pressure sensor 108, and the fluid meter 110. As shown in FIG. 1A, the computing device 112 is wirelessly connected to the pump 106, the pressure sensor 108, and the fluid meter 110. The computing device 112 includes a memory 114 storing program instructions and at least one processor 116 configured to execute program instructions and an electrical circuitry 118 to determine the number of the periodic perforations in the horizontal fracturing pipe 104 which produce a maximum volume of material forced out of the fractures without interference from breakdowns in the shale layer 120 between the fractures. In an example, the material forced out of the fractures includes at least one of oil and natural gas.

The at least one processor is configured to the execute program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an estimated fracture surface area of the horizontal fracture field and $A_{Ca}$ represents an actual fracture surface area of the horizontal fracture field, determine a net present value NPV for each spacing distance, and determine the spacing distance which minimizes the percentage of interference PI while maximizing the net present value NPV.

Figure 1B:
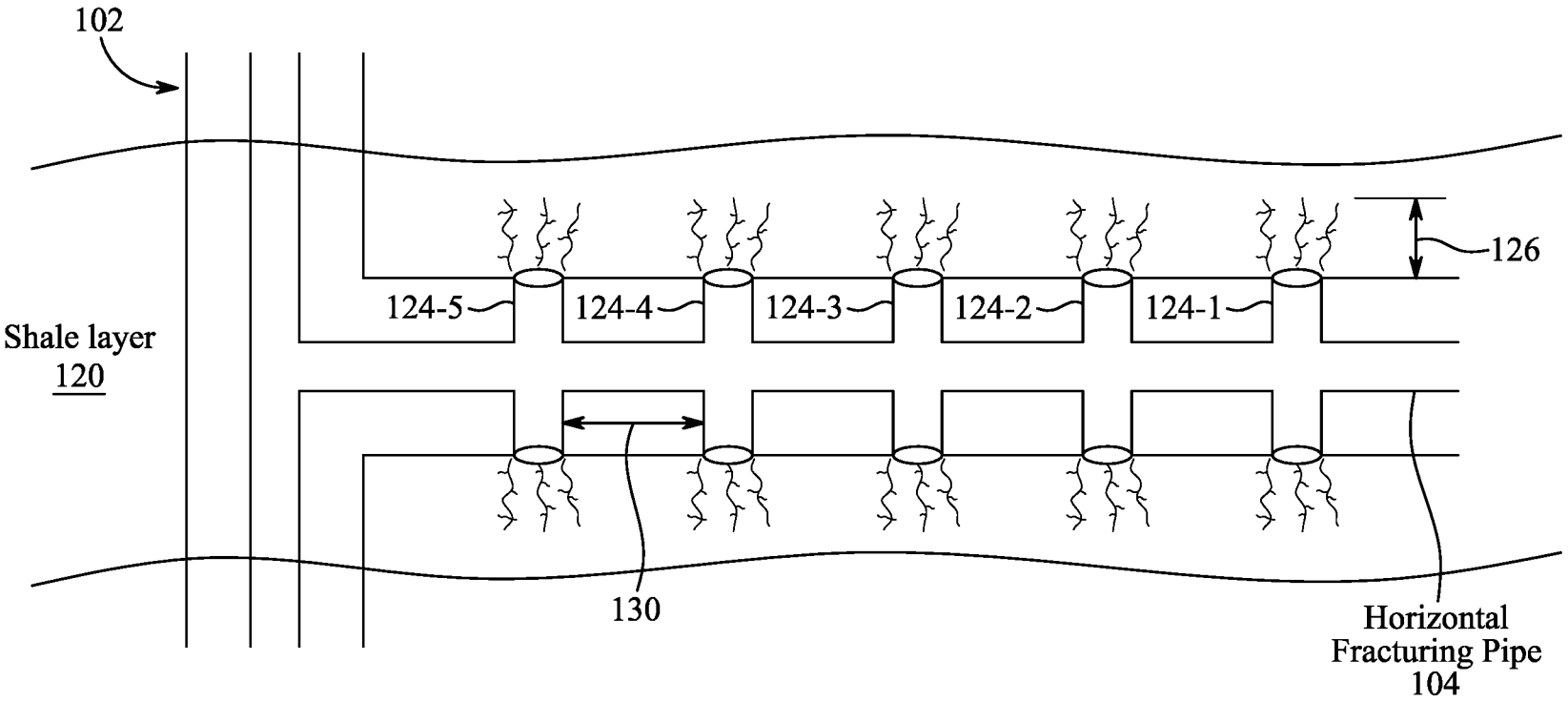
FIG. 1B depicts an exploded view of a horizontal fracturing pipe with perforations.

FIG. 1B depicts an expanded view of the horizontal fracturing pipe 104 having perforations and located in a shale layer 120.

In FIG. 1B, five perforations (i.e., $N_f$=5) are shown. The five perforations are represented by reference numerals "124-1", "124-2", "124-3", "124-4", and "124-5", respectively. As shown in FIG. 1B, each perforation generates a cluster of fractures. In the example shown in FIG. 1B, the fracture half-length (denoted by "$X_f$") is represented by reference numeral "126". In an example, the fracture half-length is 250 feet (76 meters). The cluster spacing (also referred to as fracture spacing) is represented by reference numeral "130" in FIG. 1B. In an example, the cluster spacing distance is 80 feet (about 24 meters). A length of assembled horizontal fracturing pipe may extend up to a mile (1.6 km) within the shale layer 120.

Figure 2:
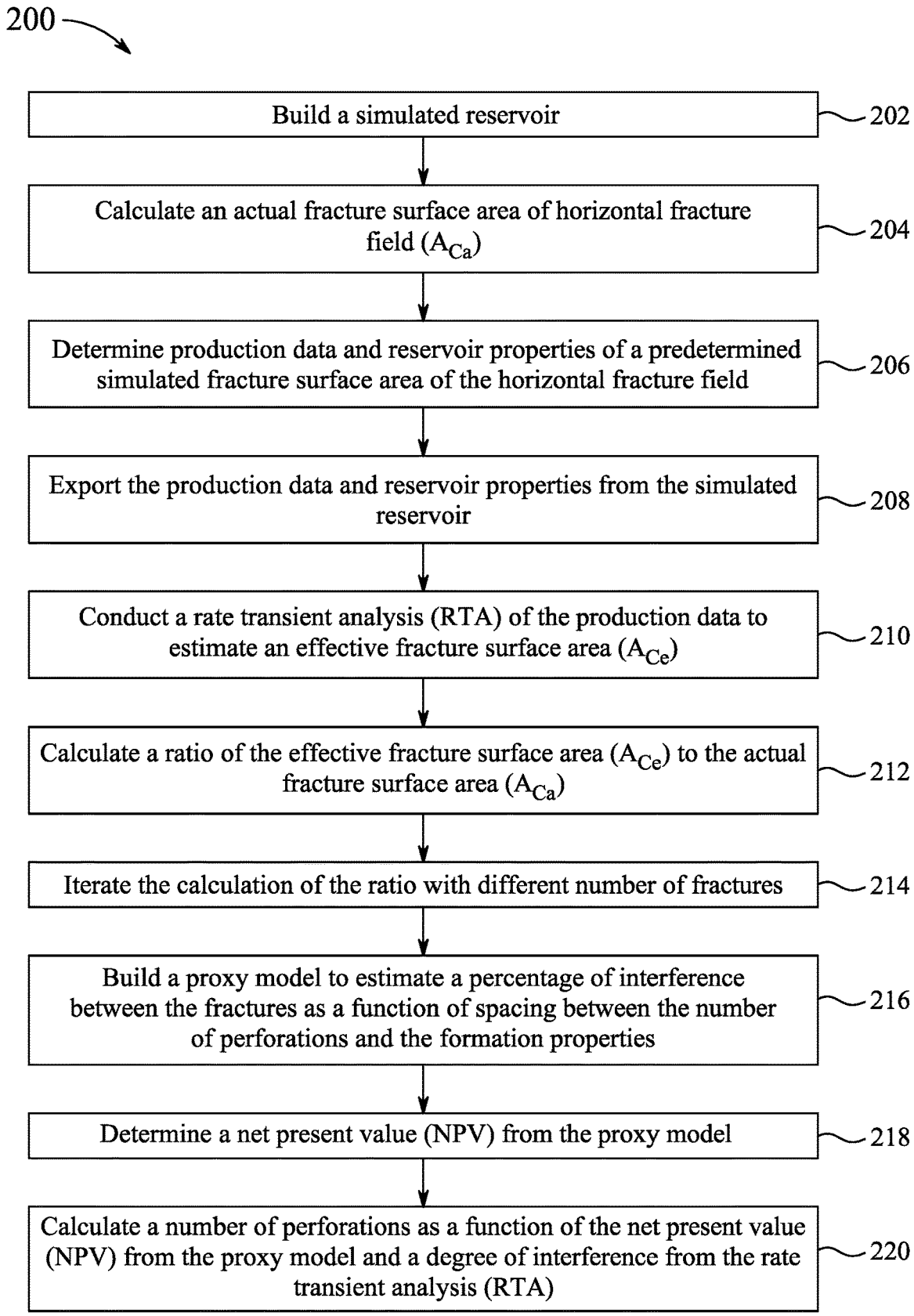
FIG. 2 depicts a flow chart for investigating fracture interference as a function of formation properties and cluster facing.

FIG. 2 depicts a flow chart 200 for investigating fracture interference as a function of formation properties and cluster facing.

At step 202 of the flow chart 200, a simulated reservoir is built using data input by a user or accessed from reservoir statistics. In an implementation, the computing device 112 is configured to build the simulated reservoir based on a horizontal fracture field for a first number of periodic perforations. In an example, the computing device 112 is configured to build the simulated reservoir by calculating a function which includes a length of the reservoir, a thickness of the reservoir, an initial reservoir pressure, a reservoir bottom-hole pressure, a reservoir temperature, a reservoir formation porosity, and a reservoir permeability. The length of the reservoir, the thickness of the reservoir, the initial reservoir pressure, the reservoir bottom-hole pressure, the reservoir temperature, the reservoir formation porosity, and the reservoir permeability are known parameters which are characteristic of the borehole and reservoir, and which have been previously measured.

At step 204 of the flow chart 200, an actual fracture surface area ($A_{Ca}$) of the horizontal fracture field is calculated. In an implementation, the computing device 112 is configured to calculate the actual fracture surface area ($A_{Ca}$) of the horizontal fracture field. In an example, the computing device 112 is configured to calculate the actual fracture surface area ($A_{Ca}$) based on Equation (1) provided below.

$$A_{Ca}=4H_fV_fX_f \tag{1}$$

where, $H_f$ represents a fracture height, $X_f$ represents a fracture half-length, and $N_f$ represents the number of perforations.

At step 206 of the flow chart 200, production data and reservoir properties of a predetermined simulated fracture surface area of the horizontal fracture field are determined. In an implementation, the computing device 112 is configured to determine the production data and reservoir properties of the predetermined stimulated fracture surface area of the horizontal fracture field from the pump pressure, the measurements of pressure sensor 108, and the fluid meter 110.

At step 208 of the flow chart 200, the production data and the reservoir properties are exported from the simulated reservoir. In an implementation, the computing device 112 is configured to export the production data and the reservoir properties from the simulated reservoir at the predetermined stimulated fracture surface area.

At step 210 of the flow chart 200, a rate transient analysis (RTA) of the production data is conducted to estimate an effective fracture surface area ($A_{Ce}$). The computing device 112 is configured to conduct the rate transient analysis (RTA) of the production data to estimate the effective fracture surface area ($A_{Ce}$) for the given number of periodic perforations. The computing device 112 is configured to conduct the RTA based on a fracture half-length which ranges from 200 feet to 400 feet.

In a rate transient analysis (RTA) for a gas well, a bottom-hole pressure (denoted by "$p_{wf}$") is converted into a pseudo bottom-hole pressure (denoted by "$m(p_{wf})$"), where m is the slope. The pseudo-pressure difference between the pseudo bottom-hole pressure and the bottom-hole pressure is then normalized using the gas production rate of the gas well. The normalized pseudo-pressure difference and linear superposition time (super-t) is used to plot the RTA for $A_c$ characterization. Normalized pseudo-pressure and linear superposition time may be calculated using Equations (2), (3), and (4), provided below.

$$\text{Normalized pseudo-pressure difference} = [m(p_i) - m(p_{wf})]/q_g \quad (2)$$

$$\text{where } m(p) = 2\int_0^p \frac{p\,dp}{\mu z} \quad (3)$$

$$\text{Super-}t = \left[\sum_{j=1}^{n} \frac{q_j - q_{j-1}}{q_n}\sqrt{t_n - t_{j-1}}\right]^2 \quad (4)$$

where $p_i$ represents the initial reservoir pressure, $p_{wf}$ represents the bottom-hole pressure, p represents the gas viscosity, z represents the compressibility factor, n represents the time step at which super-t is calculated, j represents the time step from 0 to n, and $q_g$ represents the gas production rate.

At step 212 of the flow chart 200, a ratio of the $A_{Ce}$ to the $A_{Ca}$ is calculated. In an implementation, the computing device 112 is configured to calculate the ratio of the $A_{Ce}$ to $A_{Ca}$. The computing device 112 is configured to store the ratio of the $A_{Ce}$ to the $A_{Ca}$ for the first number of periodic perforations in the memory 114.

At step 214 of the flow chart 200, the calculation of the ratio of the $A_{Ce}$ to the $A_{Ca}$ is iterated with different numbers of periodic perforations. The computing device 112 is configured to iterate the calculation of the ratio for a second number of periodic perforations. In an example, the second number is greater than the first number by a step amount. The computing device 112 is configured to continue to iterate the calculation of the ratio by adding the step amount to each previous number of periodic perforations until the production is less than or equal to a threshold amount. In an example, the computing device 112 is configured to iterate the calculation of the ratio for the number of periodic perforations ranging from 2 perforations to 20 perforations with a cluster spacing ranging from 20 feet to 200 feet. In a non-limiting example, the threshold amount is 50%. In another non-limiting example, the threshold amount is 80%. The threshold amount may be selected from the range of 20% to 99% and may change as the production increases or decreases.

At step 216 of the flow chart 200, a proxy model is built to estimate a percentage of interference (interchangeably referred to as a degree of interference) between the fractures as a function of spacing between the number of perforations and the formation properties. The computing device 112 is configured to build the proxy model to estimate the percentage of interference between the fractures as the function of spacing distance between the number of perforations and the formation properties.

At step 218 of the flow chart 200, a net present value (NPV) is determined from the proxy model. The computing device 112 is configured to determine the net present value (NPV) from the proxy model. The proxy model is a random forest (RF) model, where the RF model is configured to estimate the percentage of interference based on the simulated reservoir and the RTA. The RF model is trained on production data from the RTA which is randomly split into a training data set and a testing data set, where a ratio of the training data set to the testing data set is selected from a range of 60:40 to 80:20. In an example, the ratio of the training data set to the testing data set is 70:30.

At step 220 of the flow chart 200, a number of perforations are calculated as a function of the net present value (NPV) from the proxy model and a degree of interference from the rate transient analysis (RTA). The computing device 112 may be configured to calculate the number of perforations needed in the horizontal fracturing pipe 104 as the function of the net present value (NPV) from the proxy model and the degree of interference from the rate transient analysis (RTA).

In an implementation, the ratio of the $A_{Ce}$ to the $A_{Ca}$ represents the degree of interference between the fractures. The computing device 112 is configured to calculate the percentage of interference (PI) based on Equation (5) provided below.

$$PI = 100*(1 - A_{Ce}/A_{Ca}) \quad (5)$$

In some examples, the simulated reservoir may be built to simulate gas recovery from the simulated reservoirs for different numbers of periodic perforations and/or cluster spacings.

Figure 3:
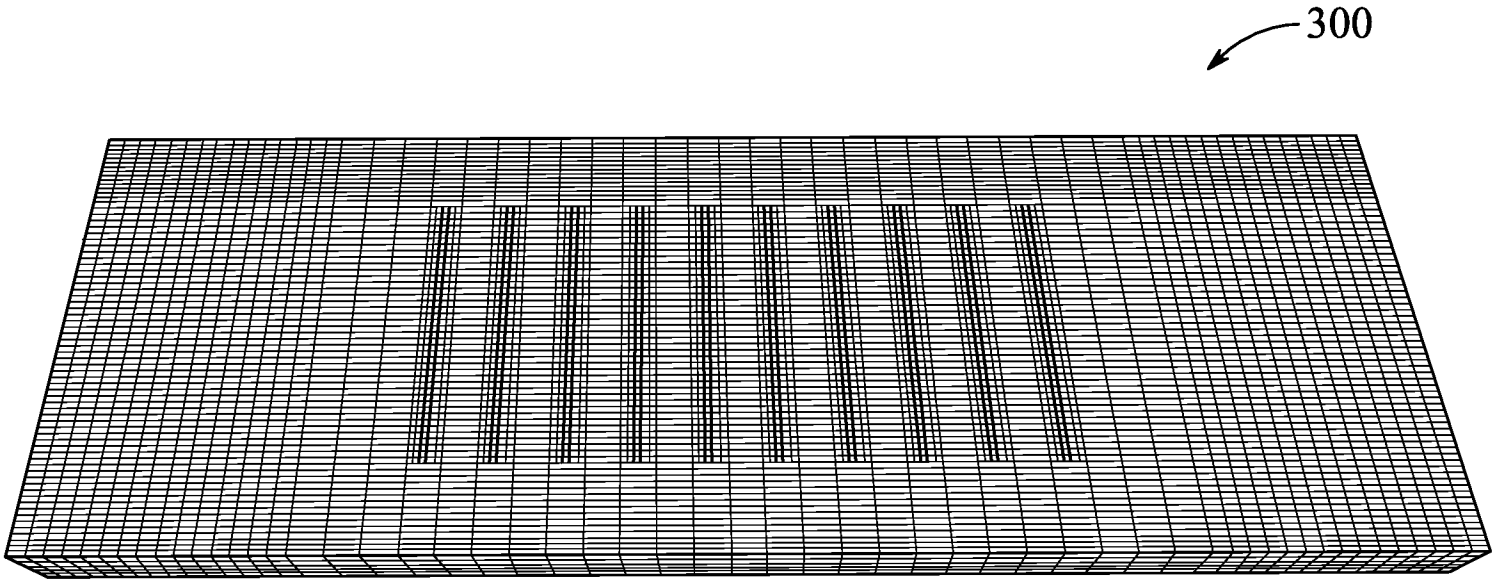
FIG. 3 depicts a representation of a simulated reservoir for a hydraulically fractured horizontal well.

FIG. 3 depicts a schematic representation 300 of a simulated reservoir for a hydraulically fractured horizontal well. In an example, the simulated reservoir was simulated as a unit for the hydraulically fractured horizontal well shown in FIG. 3. The length of the simulated reservoir was kept constant to be 250 feet in the different cases. The thickness of the simulated reservoir was selected to be 120 feet. The initial reservoir pressure was set at 5000 pound per square inch (psi), while the gas production was constrained to a bottom-hole pressure of 1000 psi. The gas gravity and the simulated reservoir temperature were set to be 0.65 and 200° F., respectively. A base case was conducted with a formation porosity of 0.065 and permeability of 100 nanoDarcies (nD).

Figure 4A:
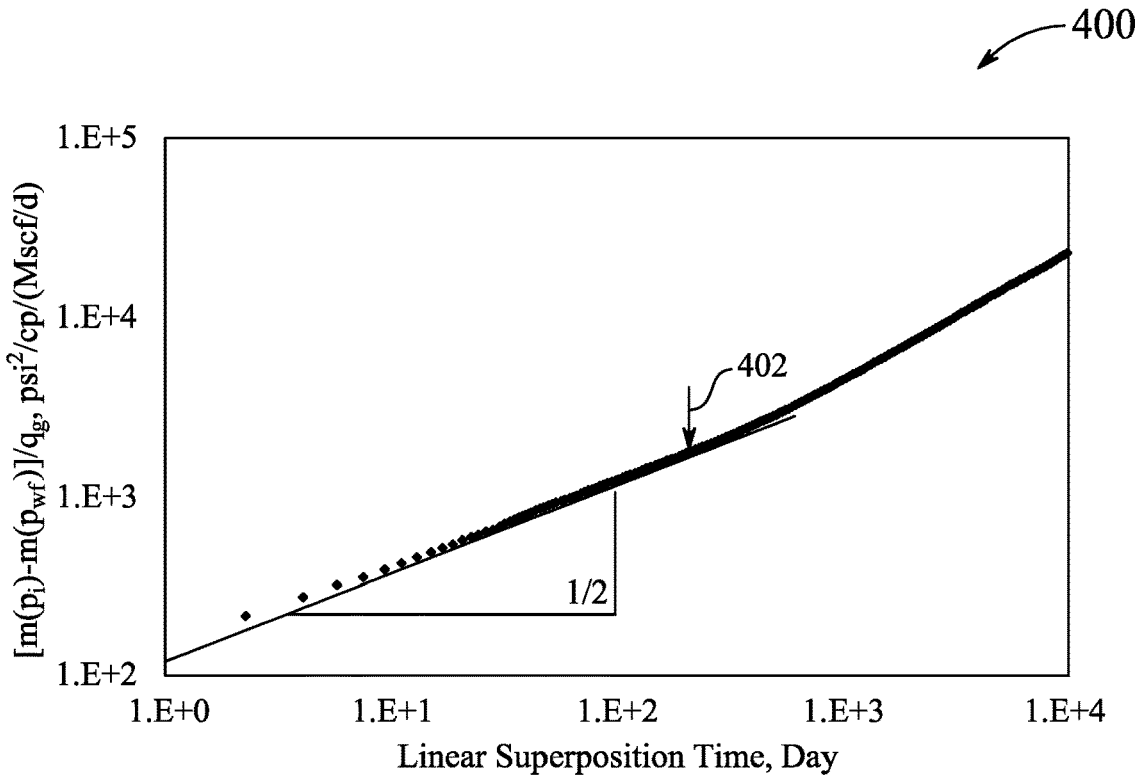
FIG. 4A depicts a rate transient analysis (RTA) analysis for a gas shale well.
Figure 4B:
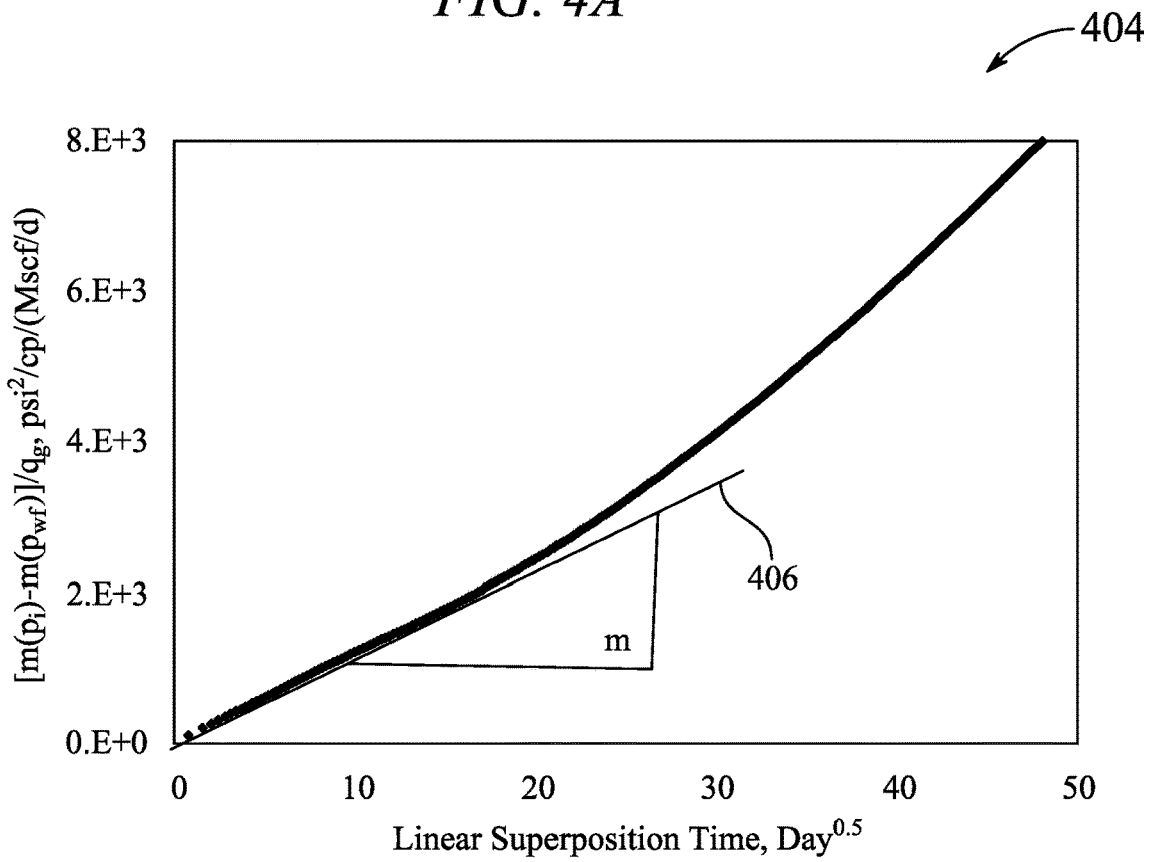
FIG. 4B depicts a rate transient analysis (RTA) analysis for a gas shale well for a linear flow region.

FIG. 4A and FIG. 4B depict an RTA analysis for gas shale well. In particular, FIG. 4A depicts a diagnostic plot 400 of a pseudopressure difference between the pseudo bottom-hole pressure and the bottom-hole pressure divided by the gas production rate versus time. The diagnostic plot 400 depicts a linear flow with a slope of one half. In FIG. 4A, arrow 402 represents an end of the linear flow.

FIG. 4B depicts a specialized plot 404 for linear flow regime. A straight line (represented by reference numeral "406") was found in the plot 404 with a slope (m). In an implementation, $\sqrt{k}A_c$ may be calculated from the slope (m) using Equation (6) provided below.

$$\sqrt{k}\,A_c = \frac{803.2427}{\sqrt{(\phi\mu c_t)_i}}\left\{\frac{T}{m}\right\} \quad (6)$$

where $A_c$ represents the total fracture surface area which reflects the effective area for the fluid production, ø represents formation porosity, μ represents gas viscosity, $c_t$ represents total compressibility, T represents the temperature, and k represents the formation permeability.

EXAMPLES AND EXPERIMENTS

The following examples are provided to illustrate further and to facilitate the understanding of the present disclosure.

Experimental Data and Analysis

In order to examine the percentage of fracture interference, the ratio between the effective fracture surface area ($A_{Ce}$) to the actual fracture surface area ($A_{Ca}$) was calculated. In an example, a numerical simulator was run using five fractures, where the cluster spacing was 80 feet. The single fracture half-length of 250 feet was used. Hence, the actual fracture surface area was calculated from Equation (1) to be $A_{Ca}$=6E5 $ft^2$ ($A_{Ca}$=4×120×5×250).

The numerical simulator was run to predict the production rate at constant bottom-hole pressure of 1000 psi, a formation porosity of 0.06, and a permeability of 0.0005 mD. The production and pressure data were analyzed using RTA to estimate the effective fracture surface area. The RTA analysis was conducted as shown in FIG. 3, FIG. 4A and FIG. 4B. The slope of the linear flow regime was found to be m=153 ($psi^2/cp/(Mscf/d)/Day^{0.5}$). This slope was used to calculate the effective surface area. In an example, the calculated effective surface area ($A_{Ce}$) is 4.5E5 $ft^2$. Hence, the ratio was found to be 0.75.

Figure 5:
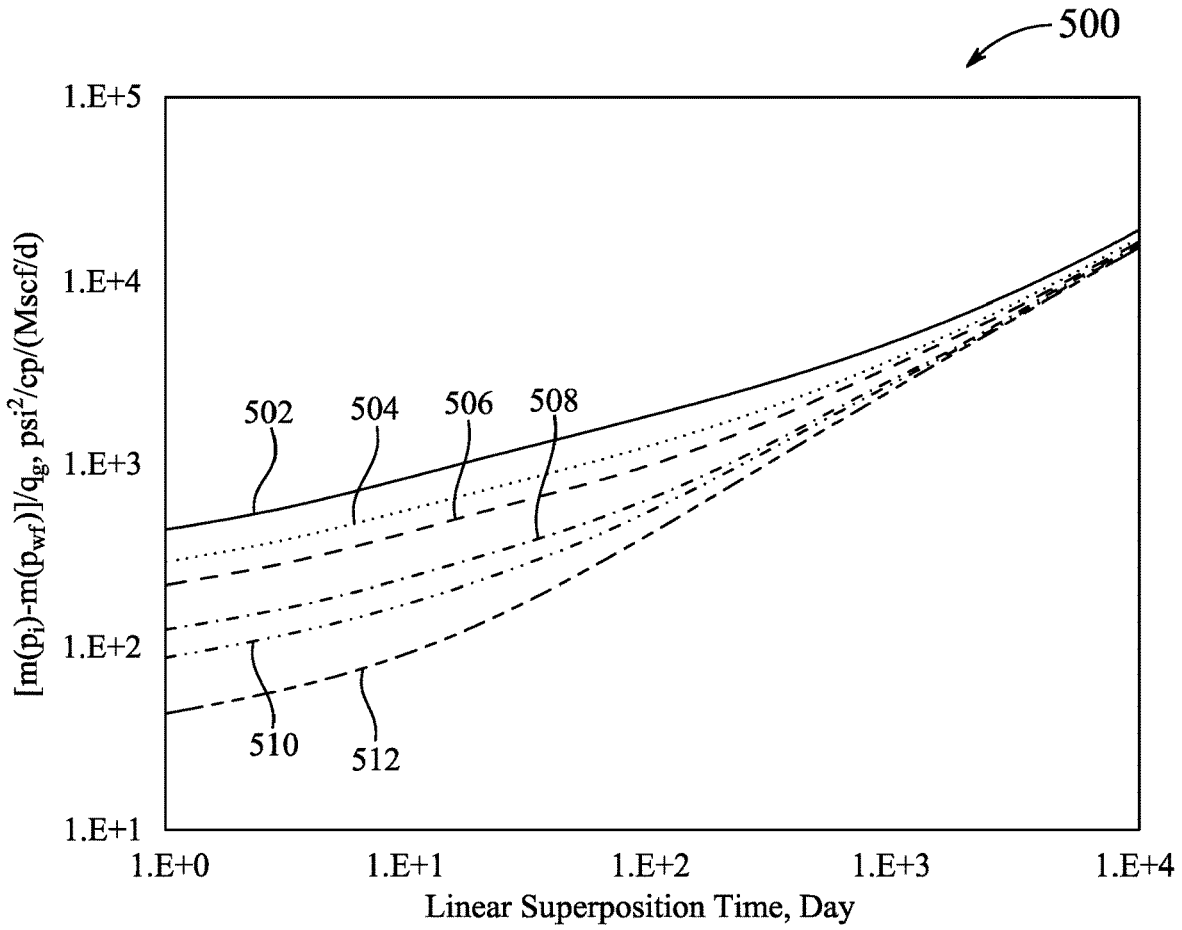
FIG. 5 depicts an RTA diagnostic plot for different numbers of perforations.

A similar analysis was conducted by changing the number of fractures from 2 fractures to fractures and the cluster spacing distance from 200 feet to 20 feet. FIG. 5 depicts an RTA diagnostic plot 500 for different numbers of perforations (or fractures). FIG. 5 shows the RTA diagnostic plot 500 of a pseudopressure difference between the pseudo bottom-hole pressure and the bottom-hole pressure divided by the gas production rate $[m(p_i)-m(p_{wf})]/q_g$ versus time. In particular, FIG. 5 depicts different cases for different number of perforations (or fractures), denoted by "$N_f$". Plot line 502 depicts a case for $N_f$=2, plot line 504 depicts a case for $N_f$=3, plot line 506 depicts a case for $N_f$=4, plot line 508 depicts a case for $N_f$=7, plot line 510 depicts a case for $N_f$=10, and plot line 512 depicts a case for $N_f$=20. In the example shown in FIG. 5, all cases showed a linear flow regime first with a ½ slope. The data then deviated from the straight line which shows the end of the linear flow regime and the beginning of fracture interference. Once the linear flow reached the end, depletion started and the production rate started to decline rapidly. In an example, the gas viscosity and the stimulated area permeability were set to be constant for the different cases. Hence, the change in the linear flow is a function of the fracture spacing distance. At a small number of fractures and long spacing, the linear fracture region was dominant, and the fracture did not interfere, or the interference occurred at a later time. With decreased fracture spacing, the linear flow regime ended earlier.

Figure 6A:
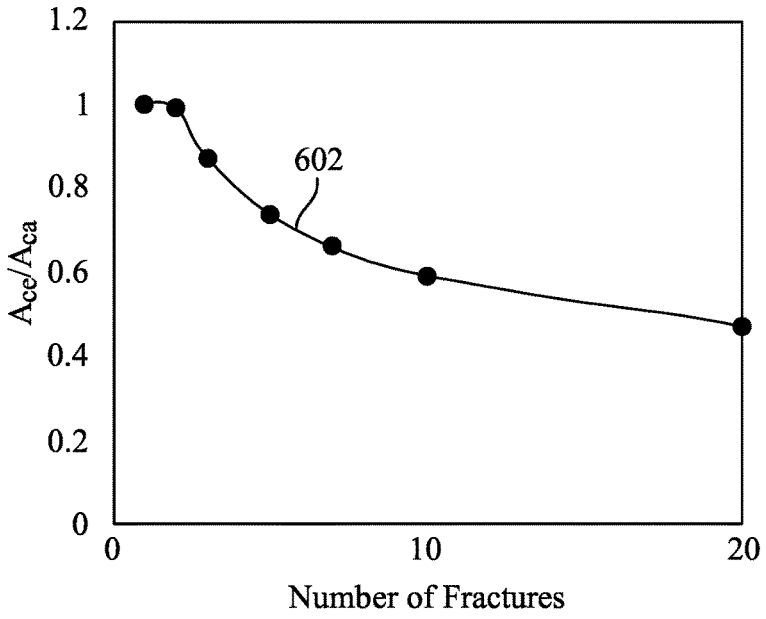
FIG. 6A shows a plot of the ratio of effective fracture surface area ($A_{Ce}$) to actual fracture surface area ($A_{Ca}$) as a function of the number of fractures.
Figure 6B:
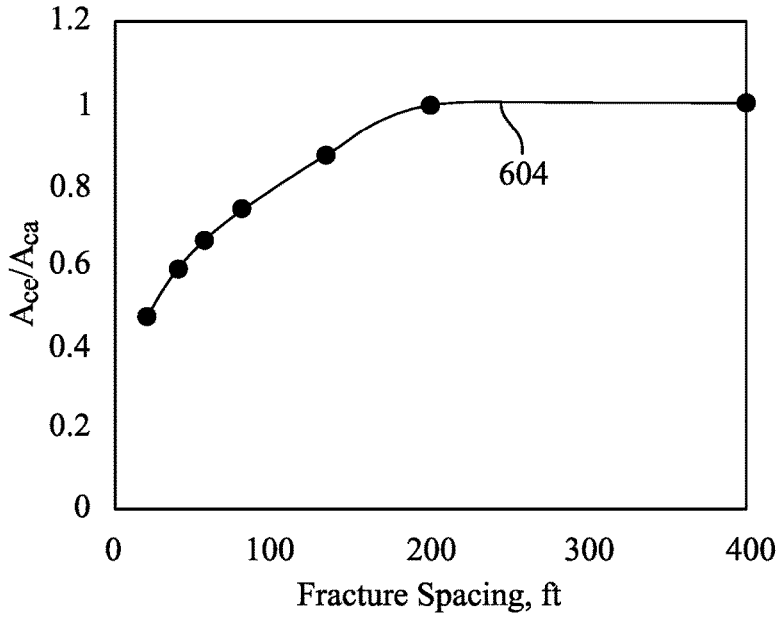
FIG. 6B shows a plot of the ratio of effective fracture surface area ($A_{Ce}$) to actual fracture surface area ($A_{Ca}$) as a function of fracture spacing.

FIG. 6A illustrates the ratio of effective fracture surface area ($A_{Ce}$) to actual fracture surface area ($A_{Ca}$) as a function of the number of fractures and FIG. 6B illustrates the ratio of effective fracture surface area ($A_{Ce}$) to actual fracture surface area ($A_{Ca}$) as a function of fracture spacing.

In particular, FIG. 6A shows the ratio between the $A_{Ce}$ to the $A_{Ca}$ as the function of the number of fractures and FIG. 6B shows the ratio between the $A_{Ce}$ to the $A_{Ca}$ as the function of the fracture spacing. In FIG. 6A, a plot line 602 depicts the ratio between the $A_{Ce}$ to the $A_{Ca}$ as the function of number of fractures. In FIG. 6B, a plot line 604 depicts the ratio between the $A_{Ce}$ to the $A_{Ca}$ as the function of the fracture spacing. In the example shown in FIG. 6A and FIG. 6B, as the fracture spacing decreased, the interference increased. In an example, at fracture spacing of 20 feet, the interference was about 50%. In addition, decreasing the cluster spacing to increase the total number of fractures significantly reduced gas recovery, where the width growth of fractures is strongly inhibited because of the mechanical interaction and stress shadow effects.

To examine the effect of the formation properties on the degree of interference between the fractures, different cases were conducted by changing the formation permeability from 0.00005 mD to 0.005 mD, setting the formation porosity as 0.065, and varying the number of fractures from 1 fracture to 20 fractures per stage.

Figure 7:
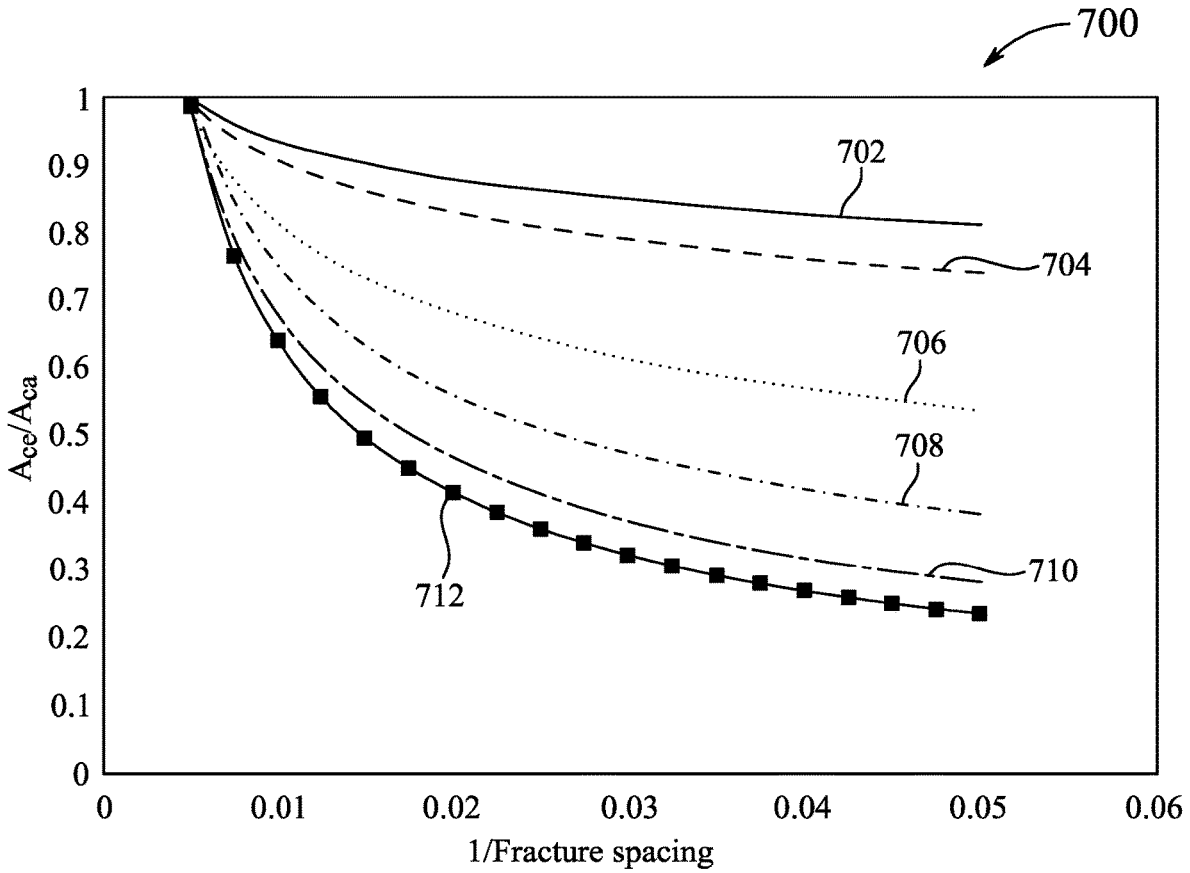
FIG. 7 illustrates a graphical representation of the ratio of the effective fracture surface area to the actual fracture surface area ($A_{Ce}/A_{Ca}$) as a function of the reciprocal of cluster spacing.

FIG. 7 illustrates a graphical representation 700 of the ratio of the effective fracture surface area to the actual fracture surface area ($A_{Ce}/A_{Ca}$) as a function of the reciprocal of cluster spacing that represents the number of fractures per unit length at different permeability values. In the example shown in FIG. 7, plot line 702 depicts permeability equal to 0.00005 mD, plot line 704 depicts permeability equal to 0.0001 mD, plot line 706 depicts permeability equal to 0.0005 mD, plot line 708 depicts permeability equal to 0.001 mD, plot line 710 depicts permeability equal to 0.003 mD, and plot line 712 depicts permeability equal to 0.005 mD. At a low permeability of 0.00005 mD, the fracture interference was very small and became more effective at short spacing with 15% interference at a spacing of 20 feet. At high permeability (for example, 0.005 mD), the fracture interference was significant even at fracture spacing of 100 feet and the fracture interference was 35%.

To examine the effect of formation porosity in the interference profile, the analysis was conducted at different porosities from 2% to 10% with formation permeability of 0.0001 mD.

Figure 8:
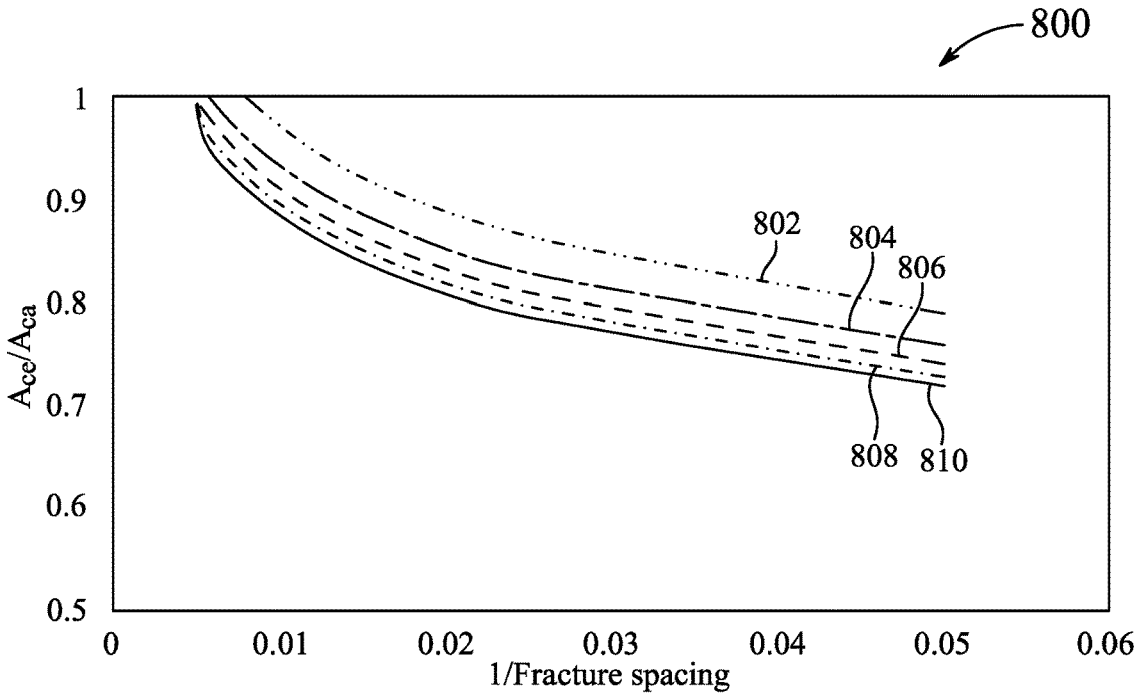
FIG. 8 illustrates a graphical representation of the ratio of the effective fracture surface area to the actual fracture surface area ($A_{Ce}/A_{Ca}$) as a function of the reciprocal of cluster spacing at different formation porosities.

FIG. 8 illustrates a graphical representation 800 of the ratio of the effective fracture surface area to the actual fracture surface area ($A_{Ce}/A_{Ca}$) as a function of reciprocal cluster spacing at different formation porosities.

In FIG. 8, plot line 802 depicts formation porosity of 0.02, plot line 804 depicts formation porosity of 0.04, plot line 806 depicts formation porosity of 0.06, plot line 808 depicts formation porosity of 0.08, and plot line 810 depicts formation porosity of 0.1. As shown in FIG. 8, the effect of the formation porosity on the interference profile was much less than the permeability effect. As can be seen, with changing the formation porosity from 2% to 10%, the interference increased from 15% to 25%.

As described earlier, the proxy model is a RF model used to determine interference ratio as a function of formation properties and cluster spacing. The input features for the RF model were the formation properties and the cluster spacing, while the target was the interference ratio.

Figure 9:
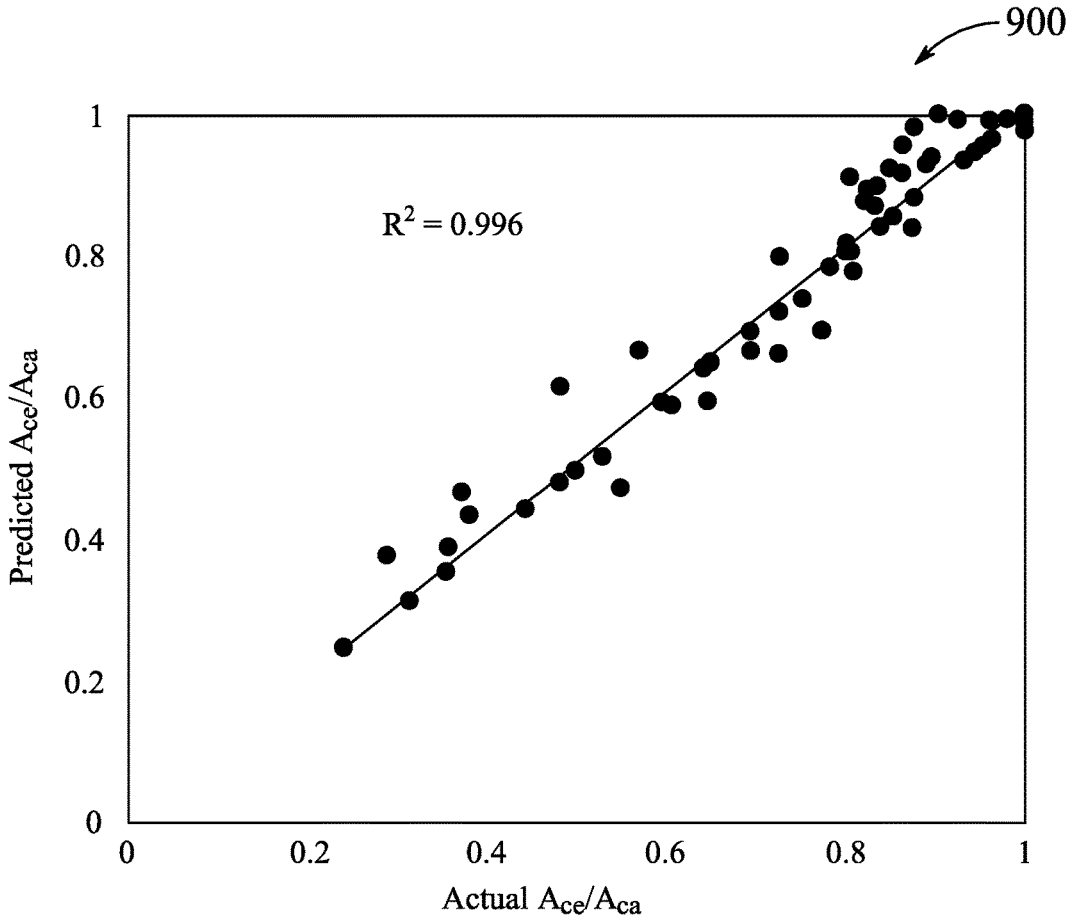
FIG. 9 displays a cross plot between an actual and a predicted interference ratio using the random forest (RF) model.

FIG. 9 displays a cross plot 900 between the actual and the predicted interference ratio using the RF model. In the example shown in FIG. 9, most of the data is aligned to the 45 degree line with an $R^2$ of 0.996, which confirms the high accuracy of the RF model and its capability to predict the interference ratio.

The RF model was then used to run a Monte Carlo sensitivity analysis on the effect of formation properties and the fracture spacing on the interference between the fractures. Table 1 provided below shows the ranges for the input parameters for the sensitivity analysis. The porosity ranged from 2% to 10% with the fracture spacing distance varying from 20 feet to 200 feet and permeability ranging from 50 nD to 5000 nD.

TABLE 1

Parameters ranges for the sensitivity analysis

| | Minimum | Maximum |
|---|---|---|
| Porosity, fraction | 0.02 | 0.1 |
| Permeability, mD | 5.00E−05 | 5.00E−03 |
| Spacing, feet | 20 | 200 |

Figure 10:
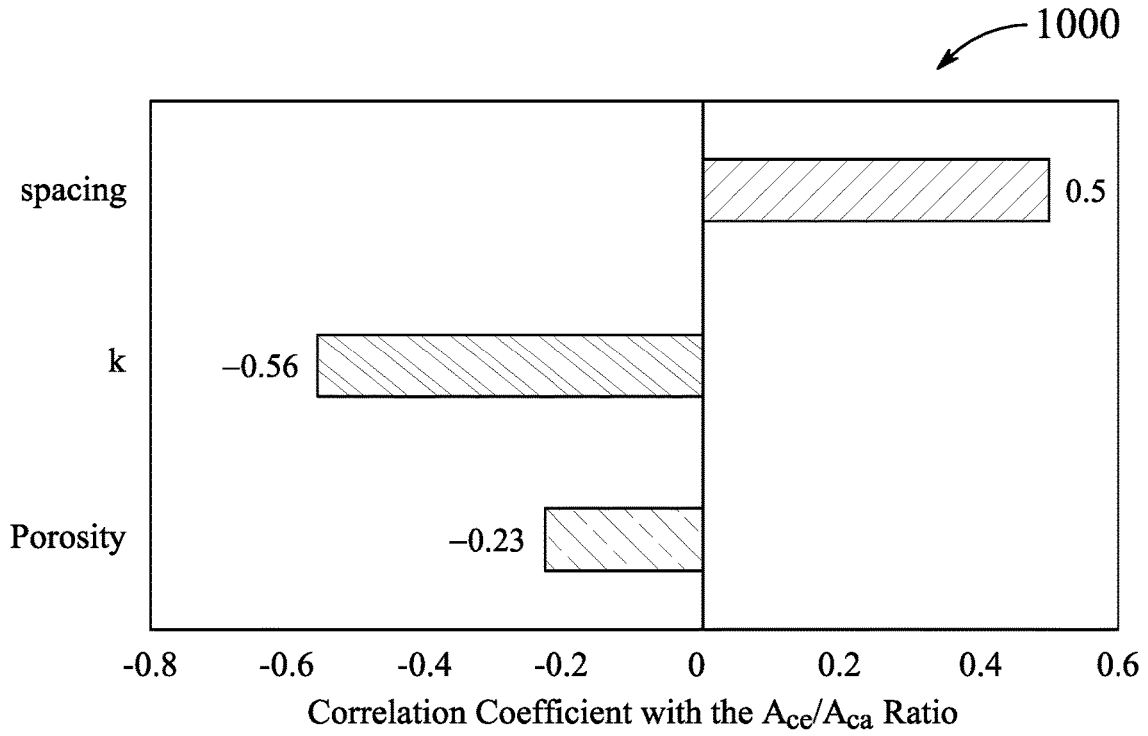
FIG. 10 depicts a graphical representation showing degree of importance of different parameters on the interference ratio.

FIG. 10 depicts a graphical representation 1000 showing the degree of importance of the different parameters on the interference ratio. FIG. 10 shows that the formation permeability k is the most effective parameter in the interference performance followed by the cluster spacing. Also, the porosity has the lowest correlation coefficient (R) of 0.23 with the $A_{Ce}/A_{Ca}$ ratio. The sign of the correlation coefficient reflects a direct or reverse relationship. For example, correlation coefficient (R) between cluster spacing and $A_{Ce}/A_{Ca}$ ratio has a positive sign. Therefore, as the cluster spacing distance increases, the $A_{Ce}/A_{Ca}$ ratio increases and the interference between the fracture decreases. While the correlation coefficient (R) for the permeability and the porosity have a negative sign. Therefore, as the porosity and the permeability increase, the $A_{Ce}/A_{Ca}$ ratio decreases and the interference between the fracture increases.

Figure 11:
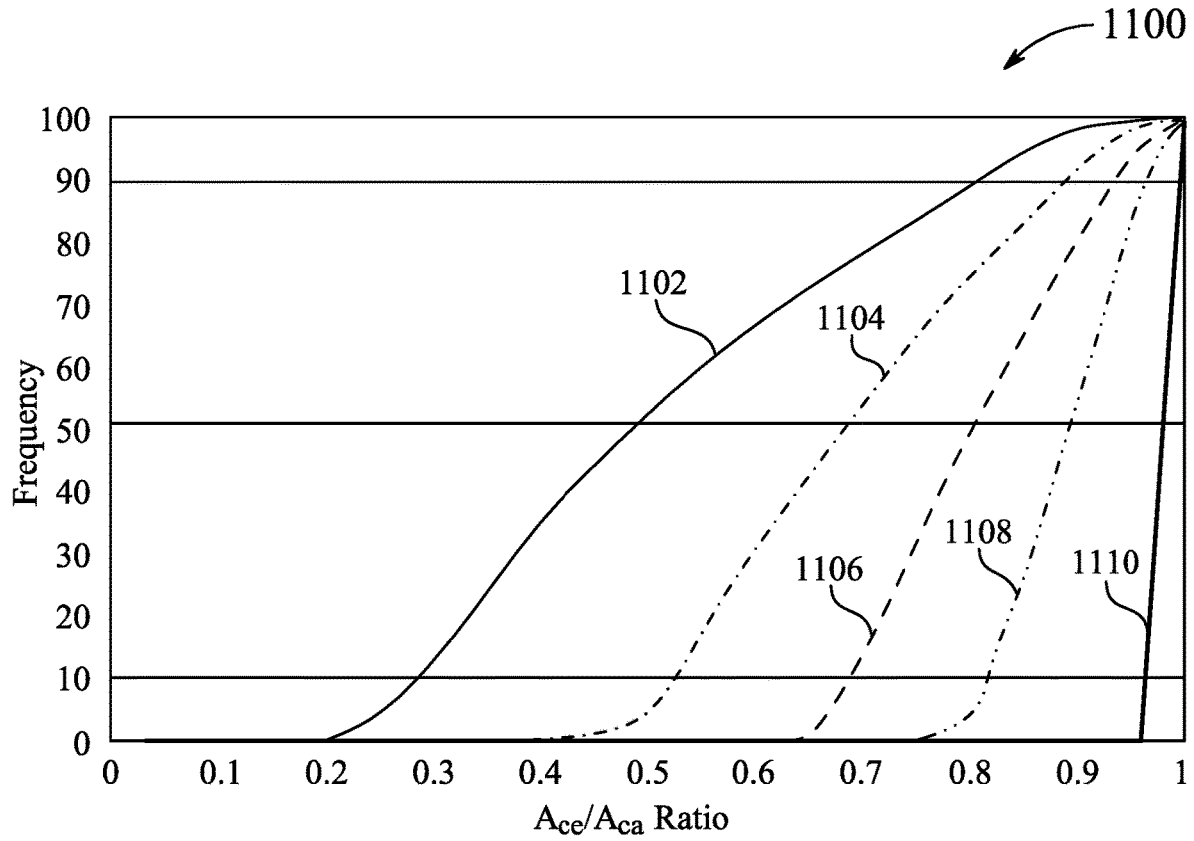
FIG. 11 depicts a graphical representation of Monte-Carlo sensitivity of frequency versus $A_{Ce}/A_{Ca}$ for uncertainty in the input parameters.

A Monte Carlo sensitivity analysis was used to investigate the effect of uncertainty of the reservoir parameters on the interference performance at different fracture spacing values. FIG. 11 depicts a graphical representation 1100 of the Monte Carlo sensitivity of frequency versus $A_{Ce}/A_{Ca}$ for uncertainty in the input parameters. In FIG. 11, plot line 1102 shows a fracture spacing of 20 feet, plot line 1104 shows a fracture spacing of 60 feet, plot line 1106 shows a fracture spacing of 100 feet, plot line 1108 shows a fracture spacing of 140 feet, and plot line 1110 shows fracture spacing of 200 feet. With decreasing fracture spacing, the whole curve shifted to the left and the $A_{Ce}/A_{Ca}$ ratio decreased. As a result, interference increased. At a fracture spacing of 200 feet, 90% of the wells have $A_{Ce}/A_{Ca}$ ratio higher than 0.97, indicating that the interference is less than 3%. With decreased fracture spacing, the $A_{Ce}/A_{Ca}$ ratio decreased. At a fracture spacing of 100 feet, 50% of the wells had an $A_{Ce}/A_{Ca}$ ratio higher than 0.8, indicating that the interference was less than 20%. At a tight spacing of 20 feet, 50% of the wells have $A_{Ce}/A_{Ca}$ ratio higher than 0.53, indicating that the interference was less than 47%.

P10, P50, and P90 refer to percentiles of the distribution. P50 (and P90, Mean, Expected and P10) is the methodology based on simulating potential scenarios with Monte Carlo simulations, where the P stands for percentile. In the oil and gas industry, P90 should be at least a 90% probability that the quantities actually recovered will equal or exceed the low estimate; P50 should be at least a 50% probability that the quantities actually recovered will equal or exceed the best estimate; P10 should be at least a 10% probability that the quantities actually recovered will equal or exceed the high estimate. P50 is a good middle estimate, mean and expected. (See "P50 (and P90, Mean, Expected and P10)", Posted on 13 Dec. 2015 by ThePD (The Project Definition)).

Table 2 provided below summarizes P10, P50, and P90 for the different fracture spacing cases.

TABLE 2

$A_{Ce}/A_{Ca}$ ratio probability at different fracture spacing

| | Spacing = 200 feet | Spacing = 170 feet | Spacing = 140 feet | Spacing = 100 feet | Spacing = 80 feet | Spacing = 60 feet | Spacing = 20 feet |
|---|---|---|---|---|---|---|---|
| P10 | 0.97 | 0.9 | 0.83 | 0.68 | 0.6 | 0.53 | 0.27 |
| P50 | 0.98 | 0.95 | 0.9 | 0.8 | 0.75 | 0.7 | 0.53 |
| P90 | 0.995 | 0.99 | 0.97 | 0.94 | 0.92 | 0.91 | 0.81 |

There are numerous economic analysis approaches in the oil and gas industry including discounted cash flow analysis, cost-benefit incremental method, cost component method, etc. In the present disclosure, discounted cash flow analysis was applied. The analysis is based on calculating the net present value (NPV) from the gas production as a function of capital cost (CAPEX), gas price, and interest rate (IRR). A base case was conducted as the numerical simulator was run to predict the production rate at constant bottom-hole pressure of 1000 psi, a formation porosity of 0.06, and a permeability of 0.0005 mD. The capital cost was assumed to be $40,000 per stage, gas price of $3/Mscf, and an interest rate of 20%.

Figure 12:
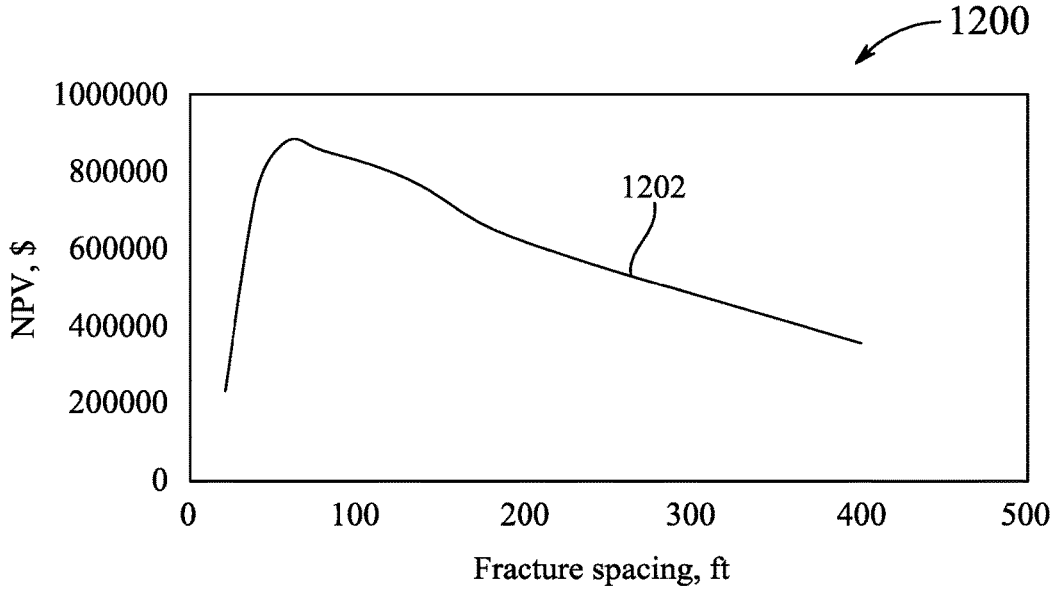
FIG. 12 shows a graphical representation of a net present value (NPV) as a function of fracture spacing.

FIG. 12 shows a graphical representation 1200 of NPV as a function of fracture spacing distances. In particular, FIG. 12 shows NPV as a function of fracture spacing distance for k=0.0005 mD, Pwf=1000 psi, and ø=0.06. In FIG. 12, plot line 1202 represents the NPV. As can be seen in FIG. 12, at a wider spacing distance of 400 feet, NPV was estimated to be 0.3 MM$. As the number of fractures increased, which decreased the spacing distance, the value of NPV increased until it reached its defined value at a spacing distance of 60 feet. As the fracture spacing distance increased, the NPV sharply declined.

Figure 13:
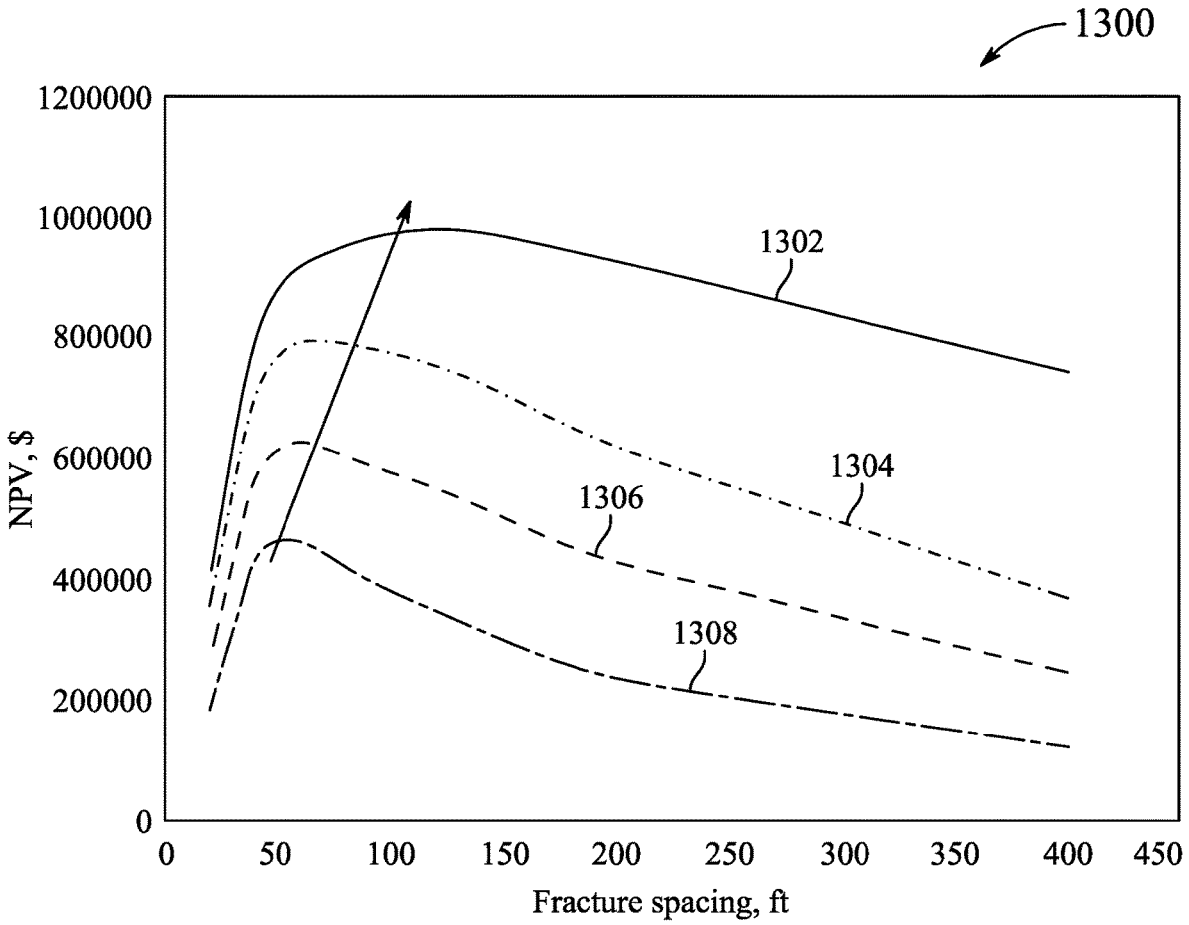
FIG. 13 shows a graphical representation of the NPV as a function of fracture spacing for different formation permeabilities.

To examine the effect of permeability on the defined cluster spacing, the previous analysis was conducted at different formation permeabilities from 0.00005 mD to 0.005 mD. FIG. 13 shows a graphical representation 1300 of the NPV as a function of fracture spacing for different formation permeabilities. In FIG. 13, plot line 1302 represents permeability of 0.005 mD, plot line 1304 represents permeability of 0.00005 mD, plot line 1306 represents permeability of 0.0001 mD, and plot line 1308 represents permeability of 0.0001 mD. As shown in FIG. 13, as the permeability increased, the entire set of curves shifted up and the NPV increased. As shown in FIG. 7, as the formation permeability increases, the fracture interference also increases. Hence, as the permeability increases, the defined cluster spacing increases. For example, the cluster spacing increased from 50 feet to 120 feet when the permeability increased from 0.00005 mD to 0.005 mD. Similarly, the effect of interest rate, gas price, and capital completion cost were investigated.

Figure 14:
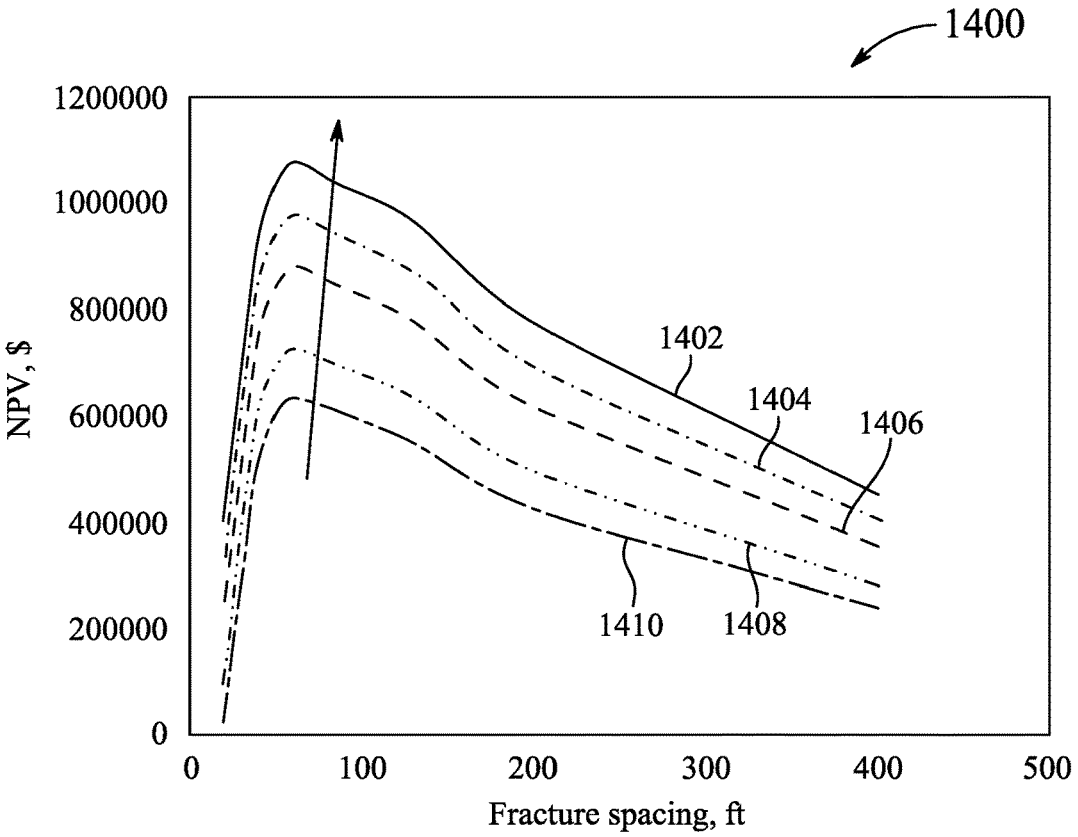
FIG. 14 shows a graphical representation of NPV as a function of fracture spacing for different interest rates.

FIG. 14 shows a graphical representation 1400 of NPV as function of a fracture spacing for different interest rates.

In FIG. 14, plot line 1402 represents an interest rate of 0.01, plot line 1404 represents an interest rate of 0.1, plot line 1406 represents an interest rate of 0.2, plot line 1408 represents an interest rate of 0.4, and plot line 1410 represents an interest rate of 0.55. The interest rate showed a slight effect on the defined spacing. As the interest rate increased from 0.05 to 0.55, the entire set of NPV curves shifted down, and defined spacing became tighter from 70 feet to 40 feet in order to accelerate the hydrocarbon recovery.

Figure 15:
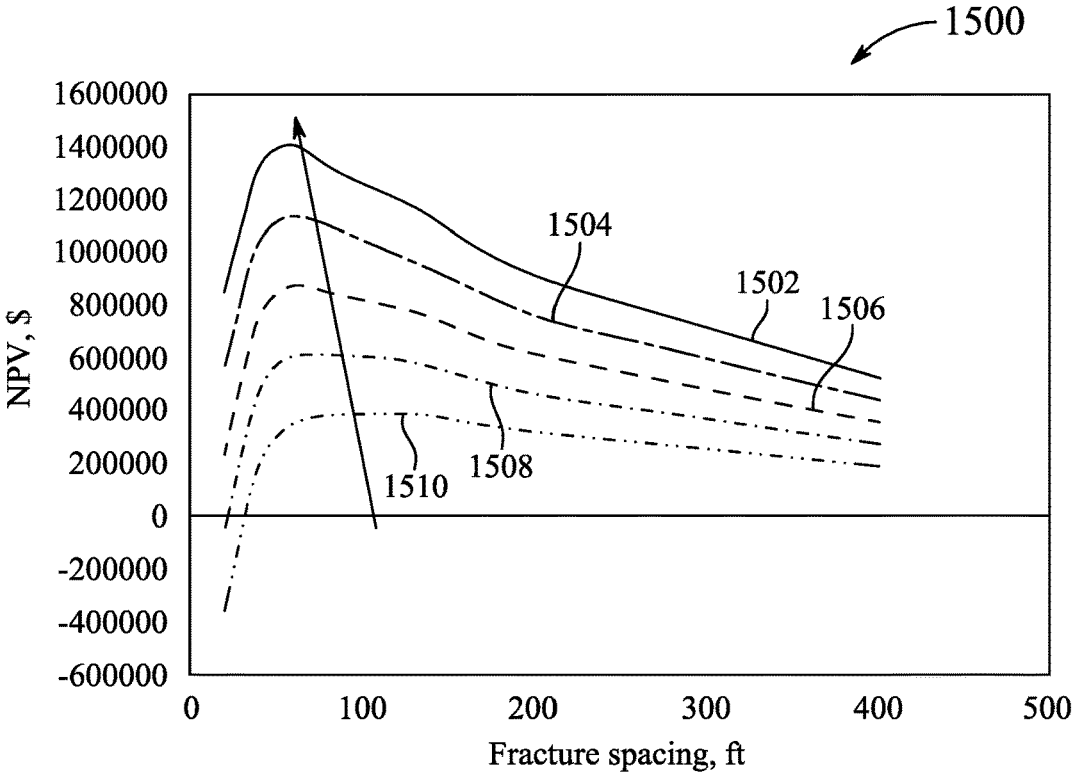
FIG. 15 shows a graphical representation of NPV as a function of fracture spacing for different gas prices.

FIG. 15 shows a graphical representation 1500 of NPV as function of a fracture spacing for different gas prices. Mscf is a production testing abbreviation for a thousand standard cubic feet per day, a common measure for volume of gas. Standard conditions are normally set at 60 degF and 14.7 psia. Psia is defined as pounds per square inch absolute.

In FIG. 15, plot line 1502 represents gas price equal to 3.5 $/Mscf, plot line 1504 represents gas price equal to 3 $/Mscf, plot line 1506 represents gas price equal to 2.5 $/Mscf, plot line 1508 represents gas price equal to 3 $/Mscf, and plot line 1510 represents gas price equal to 1.5

$/Mscf. As shown in FIG. 15, as the gas prices increased from 1.5 to 3.5 $/Mscf, the NPV increased, and the set of curves shifted upwards. The defined spacing decreased from 100 feet to 40 feet in order to accelerate the gas production and increase the profit.

Figure 16:
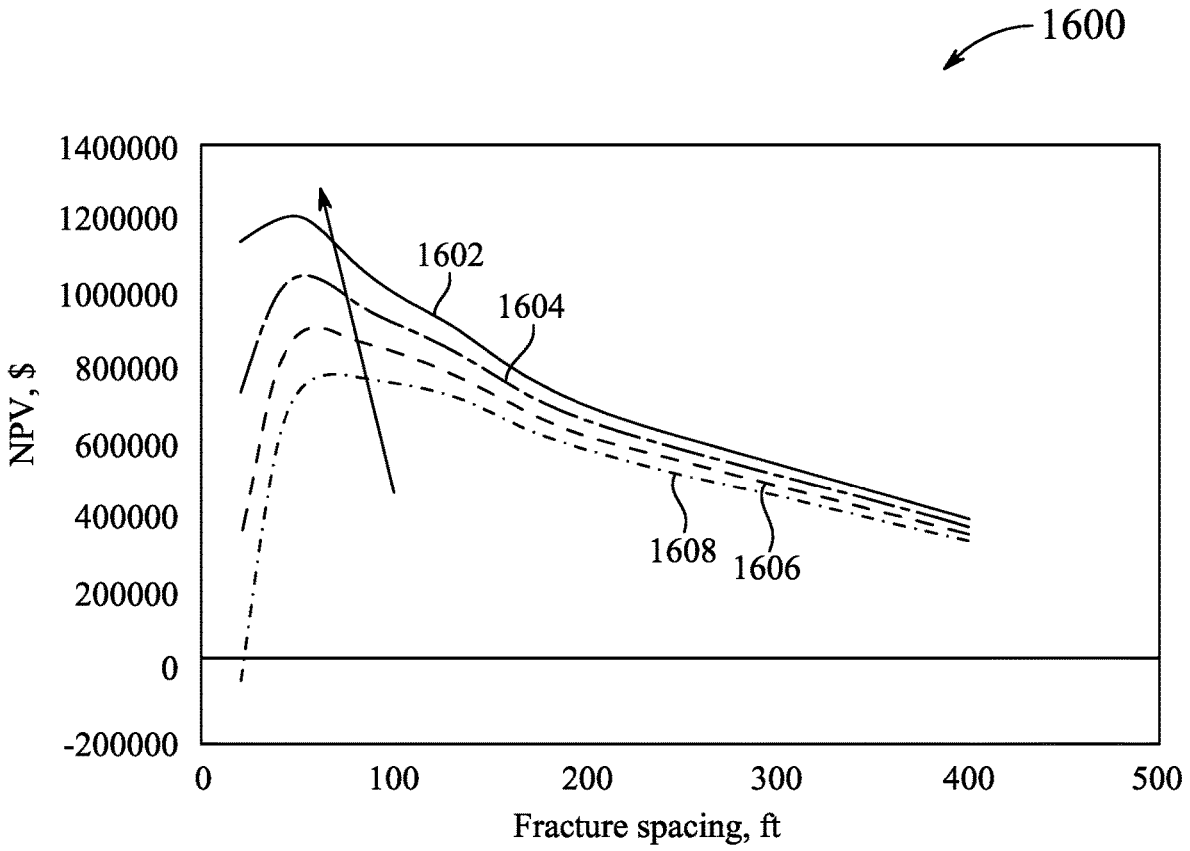
FIG. 16 shows a graphical representation of NPV as a function of fracture spacing for different capital completion costs.

FIG. 16 shows a graphical representation 1600 of NPV as a function of a fracture spacing for different capital completion costs in U. S. dollars, simply referred to below as the symbol $. MM$ refers to millions of dollars.

In FIG. 16, plot line 1602 represents cost equal to 20000 $, plot line 1604 represents cost equal to 40000 $, plot line 1606 represents cost equal to 60000 $, and plot line 1608 represents cost equal to 80000 $. As shown in FIG. 16, as the cluster spacing decreases, the hydrocarbon production increases. However, the capital cost is increased with tight spacing. Hence, as the completion cost becomes cheaper and changes from 0.8 MM$ to 0.2 MM$, a tighter spacing is recommended (for example, from 90 feet to 40 feet) to accelerate the production and improve profitability.

A case study was conducted for the production data for two gas wells (well-1 and well-2) in the Barnett shale formation. The two wells were completed with an almost similar design as shown in Table 3 provided below.

TABLE 3

Completion design for the two wells in the Barnett formation

| | Well-1 | Well-2 | Difference % |
|---|---|---|---|
| Water: gal/ft | 1715 | 1892 | 10% |
| Sand: lb/ft | 1503 | 1530 | 2% |
| Cluster Spacing, ft | 31 | 17.4 | −44% |
| AVG BPM | 67 | 63 | −6% |
| Cost, $ | X | 1.3X | 30% |

AVG BPM refers to average barrels per million.

As shown in Table 3, the cluster spacing in well-1 (also referred to as first well) was almost double the cluster spacing in well-2 (also referred to as second well). For the same lateral length, the completion cost for well-2 was 30% higher than the completion cost for well-1.

Figure 17:
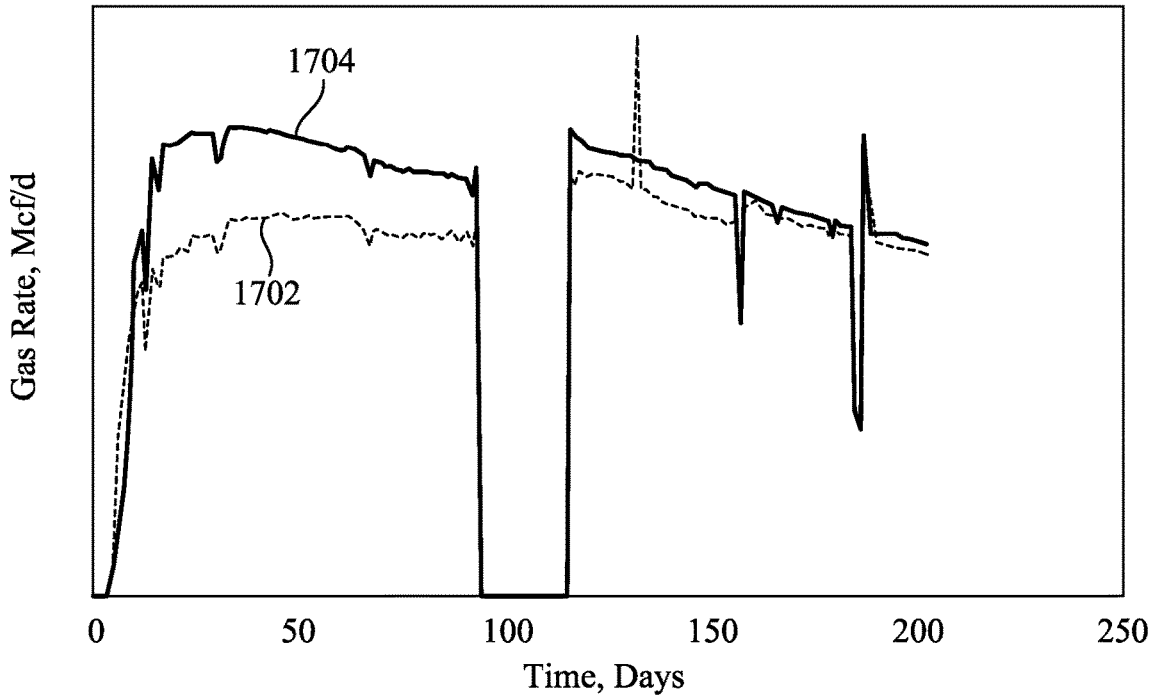
FIG. 17 shows gas production for a first well (well-1) and a second well (well-2) versus time in days.

FIG. 17 shows gas production for well-1 and well-2 versus time in days. In FIG. 17, production data for well-1 and well-2 are represented by reference numeral "1702" and "1704", respectively.

Figure 18:
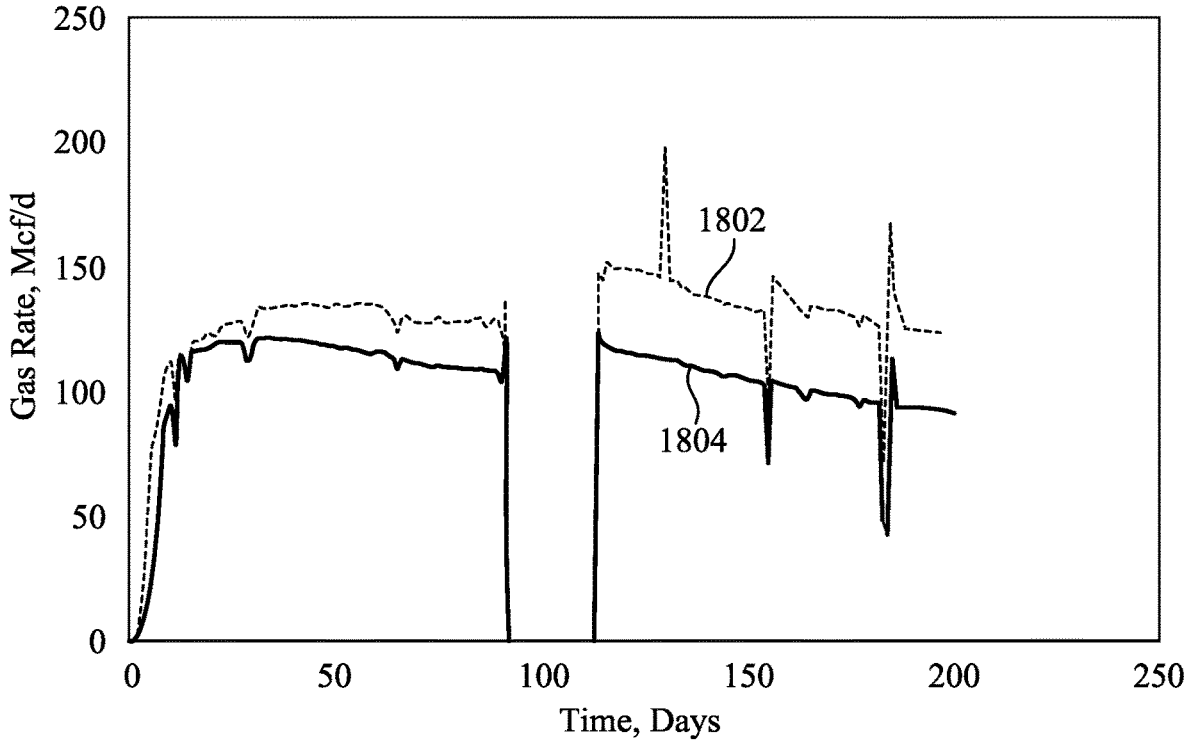
FIG. 18 shows the production data for the first well (well-1) and the second well (well-2) versus time in days for production per stage.

FIG. 18 shows the production data for well-1 and well-2 versus time in days for production per stage, i.e., time from 0 days to 100 days and time from 100 days to 200 days. In FIG. 18, the production data for well-1 and well-2 are represented by reference numerals "1802" and "1804", respectively. Well-2 with tight fracture spacing showed higher gas production data compared to well-1. However, production rate declined faster. By comparing the production per stage for each well, well-1 showed a higher production rate per stage compared to well-2. Moreover, RTA and PTA analyses were conducted in both wells to estimate the fracture surface area. Even with a lower number of clusters and wider cluster spacing, well-1 has an almost similar surface area as the one estimated from well-2. That proves that a higher number of fractures with tighter cluster spacing does not always give a higher performance. However, an economic study should be conducted to examine the effect of production acceleration by increasing the number of fractures versus increasing the capital cost of well completion. Bbl/psi is defined as barrel per (pound per square inch).

TABLE 4

PTA analysis results for wells

| VR Model Results | PTA analysis Well-1 | PTA analysis Well-2 |
|---|---|---|
| Wellbore storage, bbl/psi | 0.0085127 | 0.0197008 |
| Skin | 0.141931 | 0.065 |
| $A_c$, acre = $4N_fX_fh_f$, $A_{cr}$ | 67 | 69 |

The higher stage number and tighter cluster spacing will have high cluster interference with low effective to actual fracture surface area ratio. The formation permeability is the dominant parameter in fracture interference behavior. The porosity correlated with effective to actual fracture surface area ratio by an R-value of −0.23 compared to −0.56 in case of formation permeability. The R-value is a correlation coefficient. The sample correlation coefficient (r) is a measure of the closeness of the association of the points in a scatter plot to a linear regression line based on those points. The R-squared value, denoted by R2, is the square of the correlation coefficient. It measures the proportion of variation in the dependent variable that can be attributed to the independent variable. The R-squared value R2 is always between 0 and 1 inclusive. A proxy model was built to predict the degree of fracture interference as a function of formation properties and the cluster spacing with R2 of 0.96 between the actual and the predicted values. Based on the uncertainty analysis, regardless of the formation properties, at a spacing of 100 ft, 50% of the wells have means interference higher than 20%. At a tight spacing of 20 ft, 90% of the wells have interference higher than 20%. From the economic study, spacing of 60 ft was found to be the optimum spacing based on the formation properties, capital cost, and gas price. As the interest rate gas prices increased, or a low capital costs, the optimum completion tends to be with tighter spacing to accelerate the production. Based on the Barnett wells case study, regardless of the number of fracturing stages, for the same lateral length and the same injected frac proppant, the cumulative gas production will be the same. A well with a higher stage number and tighter cluster spacing will drain the production area faster with a high initial production rate. A well with low number of stages will drain the same area but for a longer time and at a lower initial production rate.

Figure 19:
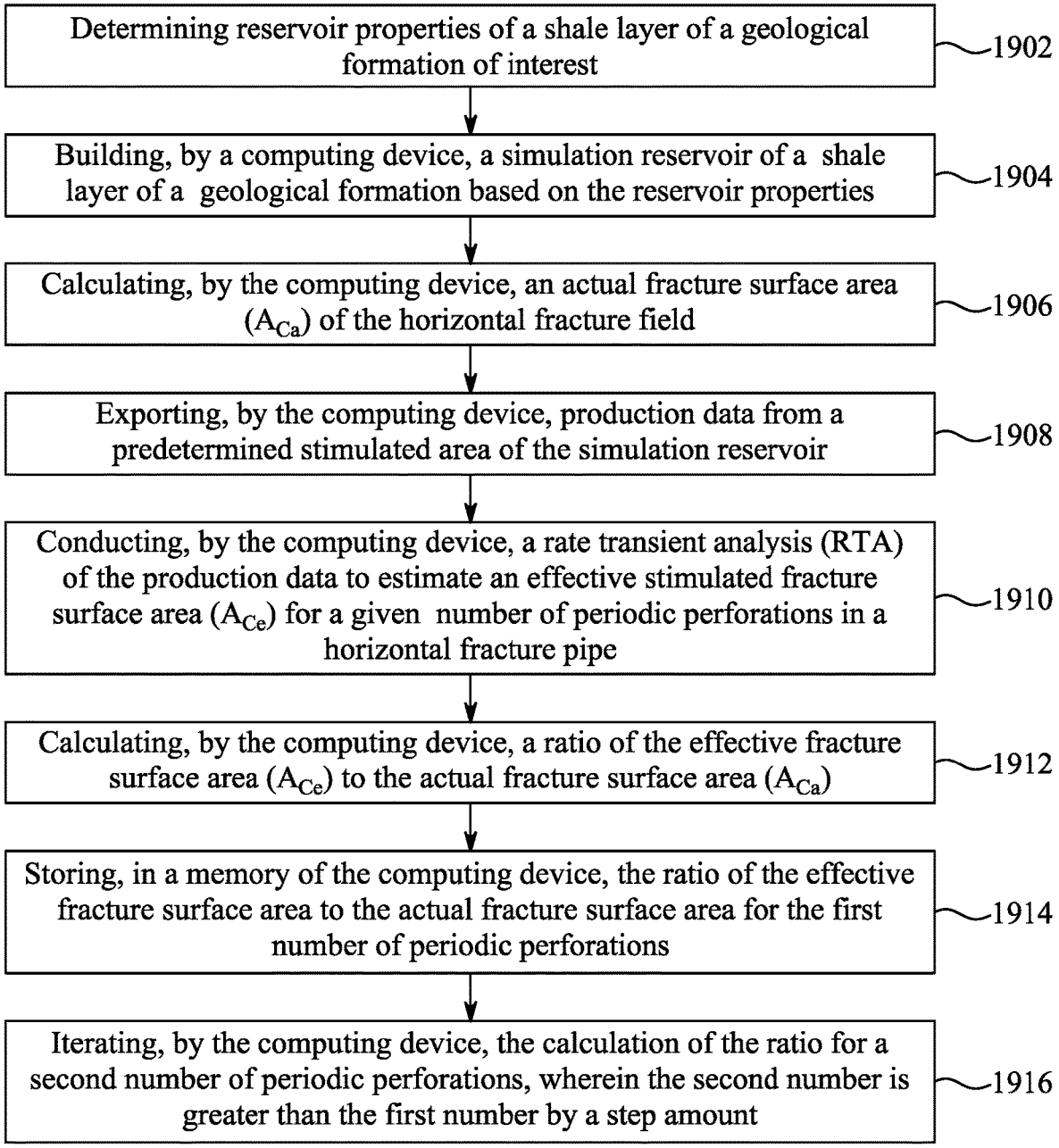
FIG. 19 illustrates a flowchart for building a horizontal fracture field having low cluster interference.
Figure 19:
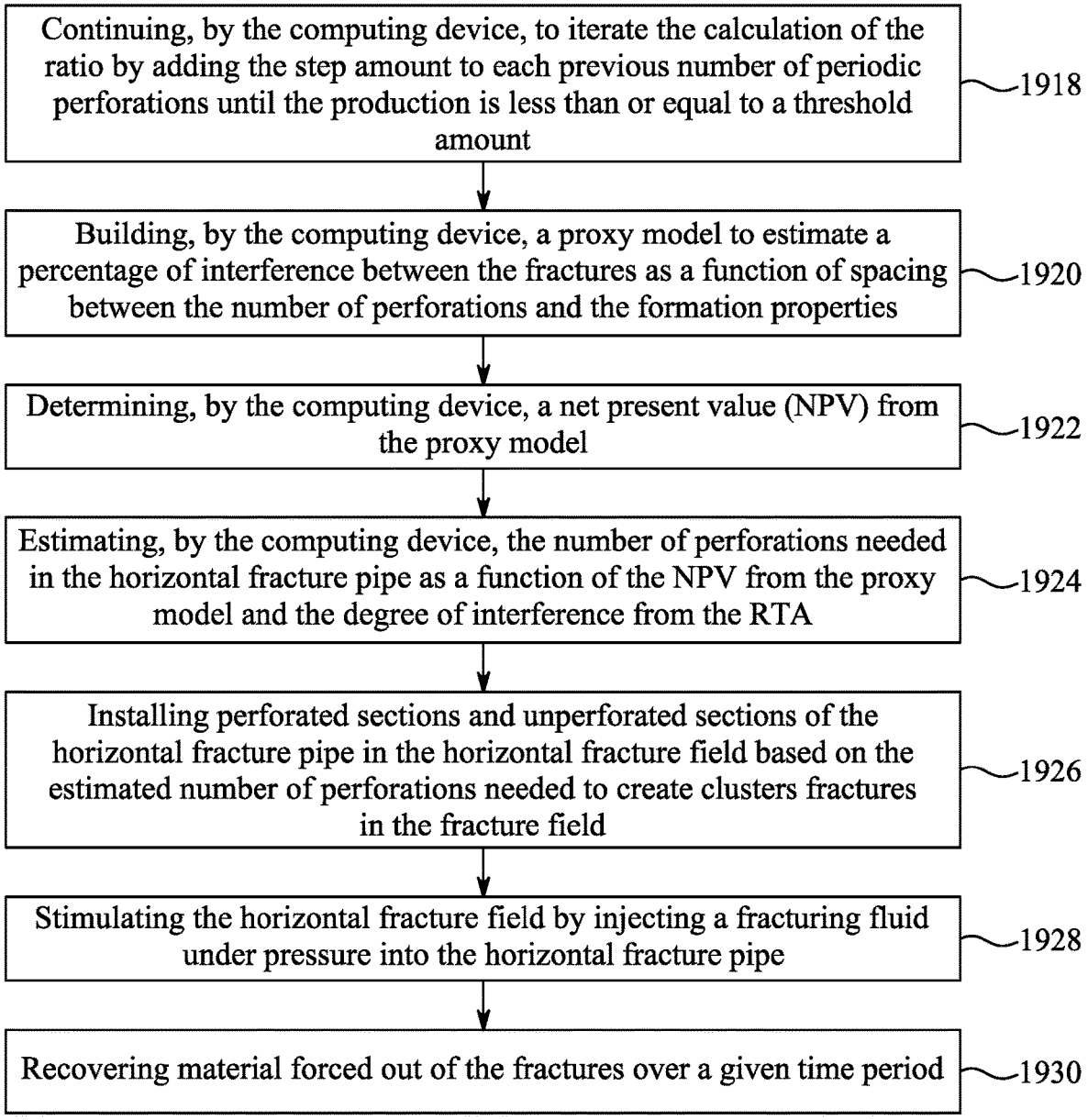

FIG. 19 illustrates a flowchart 1900 for building a horizontal fracture field having low cluster interference.

At step 1902 of the flowchart 1900, reservoir properties of a shale layer 120 of a geological formation 132 of interest are determined. The computing device 112 may be configured to determine the reservoir properties of the shale layer 120 of the geological formation 132 of interest.

At step 1904 of the flowchart 1900, a simulation reservoir of the shale layer 120 of the geological formation 132 is built based on the reservoir properties. The computing device 112 may be configured to build the simulation reservoir of the shale layer 120 of the geological formation 132 based on the reservoir properties.

At step 1906 of the flowchart 1900, an actual fracture surface area ($A_{Ca}$) of the horizontal fracture field is calculated. The computing device 112 is configured to calculate the actual fracture surface area ($A_{Ca}$) using Equation (1).

At step 1908 of the flowchart 1900, production data from a predetermined stimulated area of the simulation reservoir is exported. The computing device 112 is configured to export the production data from the predetermined stimulated area of the simulation reservoir.

At step 1910 of the flowchart 1900, a rate transient analysis (RTA) of the production data is conducted to estimate an effective stimulated fracture surface area ($A_{Ce}$) for a given number of periodic perforations in a horizontal fracturing pipe 104. The computing device 112 is configured to conduct the rate transient analysis (RTA) of the production data to estimate the effective stimulated fracture surface area ($A_{Ce}$) for the given number of periodic perforations (for example, first number of periodic perforations) in the horizontal fracturing pipe 104.

At step 1912 of the flowchart 1900, a ratio of the effective fracture surface area ($A_{Ce}$) to the actual fracture surface area ($A_{Ca}$) is calculated. The computing device 112 is configured to calculate the ratio of the effective fracture surface area ($A_{Ce}$) to the actual fracture surface area ($A_{Ca}$).

At step 1914 of the flowchart 1900, the ratio of the effective fracture surface area to the actual fracture surface area for the first number of periodic perforations is stored. The computing device 112 is configured to store the ratio of the effective fracture surface area to the actual fracture surface area for the first number of periodic perforations in the memory 114.

At step 1916 of the flowchart 1900, the calculation of the ratio for a second number of periodic perforations is iterated, where the second number is greater than the first number by a step amount. The computing device 112 is configured to iterate the calculation of the ratio for the second number of periodic perforations.

At step 1918 of the flowchart 1900, iteration to calculate the ratio is continued by adding the step amount to each previous number of periodic perforations until the production is less than or equal to a threshold amount. The computing device 112 is configured to continue the iteration to calculate the ratio by adding the step amount to each previous number of periodic perforations until the production is less than or equal to the threshold amount.

At step 1920 of the flowchart 1900, a proxy model is built to estimate a percentage of interference between the fractures as a function of spacing between the number of perforations and the formation properties. In an implementation, the computing device 112 is configured to calculate the percentage of interference (PI) using Equation (5). In an example, the proxy model is a random forest (RF) model. In an example, the RF model is trained on production data from the RTA which is randomly split into a training data set and a testing data set, where a ratio of the training data set to the testing data set is selected from a range of 60:40 to 80:20. Also, the percentage of interference is estimated based on the simulated reservoir and the RTA. In an implementation, the RF model may run a Monte Carlo sensitivity analysis on an effect of formation properties and a fracture spacing on an interference between the fractures. In an example, the porosity is ranged from 2% and 10%, the fracture spacing is varied from 20 to 200 ft, and the permeability is varied from 50 to 5000 nanoDarcies (nD). In an implementation, the computing device 112 may be configured to conduct the RTA by converting a bottom-hole pressure to a pseudo bottom-hole pressure and normalizing a pseudo-pressure difference between the pseudo bottom-hole pressure and the bottom-hole pressure via a gas production rate of the well.

At step 1922 of the flowchart 1900, a net present value (NPV) from the proxy model is determined. In an implementation, the computing device 112 may be configured to determine the net present value (NPV) from the proxy model.

At step 1924 of the flowchart 1900, the number of perforations needed in the horizontal fracturing pipe 104 is estimated as a function of the NPV from the proxy model and the degree of interference from the RTA. In an implementation, the computing device 112 is configured to estimate the number of perforations needed in the horizontal fracturing pipe 104 as a function of maximizing the NPV from the proxy model and minimizing the degree of interference from the RTA.

At step 1926 of the flowchart 1900, perforated sections and unperforated sections of the horizontal fracturing pipe are installed in the horizontal fracture field based on the estimated number of perforations needed to create clusters of fractures in the fracture field. In an implementation, the perforated sections and unperforated sections of the horizontal fracturing pipe 104 are installed in the horizontal fracture field based on the estimated number of perforations needed to create clusters fractures in the fracture field.

At step 1928 of the flowchart 1900, the horizontal fracture field is stimulated by injecting a fracturing fluid 134 under pressure into the horizontal fracturing pipe.

At step 1930 of the flowchart 1900, material forced out of the fractures is recovered over a given time period. In an example, the material forced out of the fractures includes at least one of oil and natural gas.

Figure 20:
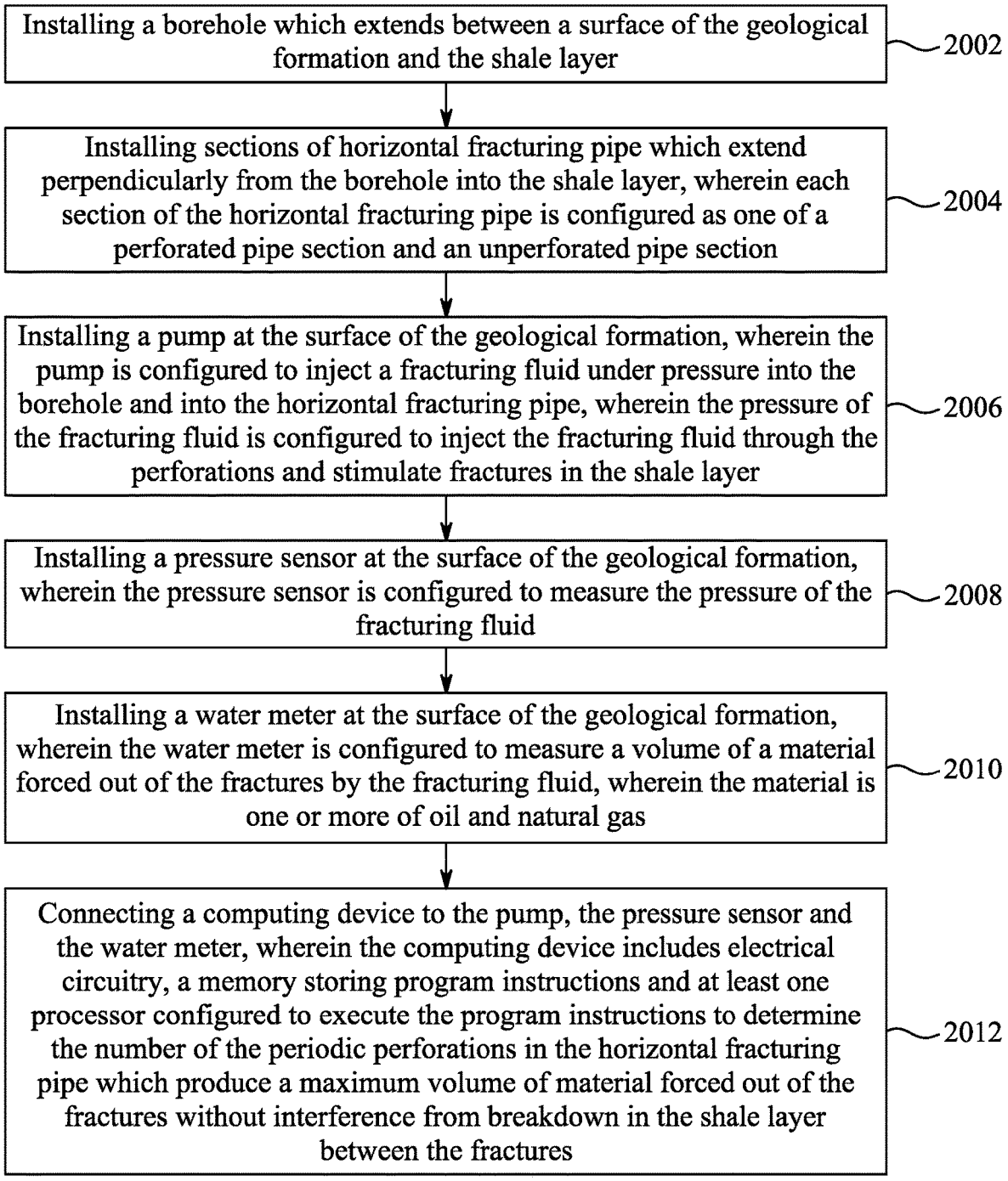
FIG. 20 illustrates a flowchart for hydraulic fracturing in a shale layer of a geological formation.

FIG. 20 illustrates a flowchart 2000 for hydraulic fracturing in a shale layer 120 of a geological formation 132.

At step 2002 of the flowchart 2000, a borehole 102 is drilled and cased which extends between a surface of the geological formation 132 and the shale layer 120.

At step 2004 of the flowchart 2000, sections of horizontal fracturing pipe 104 are installed which extend perpendicularly from the borehole 102 into the shale layer 120, where each section of the horizontal fracturing pipe 104 is configured as one of a perforated pipe section and an unperforated pipe section. The number of perforations in each pipe section and the length of each pipe section are selected such that a fully installed length of horizontal fracturing pipe has the number of periodic perforations determined by the model.

At step 2006 of the flowchart 2000, a pump 106 is installed at the surface of the geological formation 132, where the pump 106 is configured to inject a fracturing fluid 134 under pressure into the borehole 102 and into the horizontal fracturing pipe 104, and where the pressure of the fracturing fluid 134 is configured to inject the fracturing fluid 134 through the perforations and stimulate fractures in the shale layer 120.

At step 2008 of the flowchart 2000, a pressure sensor 108 is installed at the surface of the geological formation 132, wherein the pressure sensor 108 is configured to measure the pressure of the fracturing fluid 134.

At step 2010 of the flowchart 2000, a water meter (also referred to as fluid meter 110) is installed at the surface of the geological formation 132, where the water meter is configured to measure a volume of a material forced out of the fractures by the fracturing fluid 134, and where the material is one or more of oil and natural gas.

At step 2012 of the flowchart 2000, a computing device 112 is connected to the pump 106, the pressure sensor 108 and the water meter, where the computing device 112 includes electrical circuitry 118, a memory 114 storing program instructions and at least one processor 116 configured to execute the program instructions to determine the number of the periodic perforations in the horizontal fracturing pipe 104 which produces a maximum volume of material forced out of the fractures without interference from breakdown in the shale layer 120 between the fractures.

The computing device 112 is configured to build a simulation reservoir of the shale layer 120 of the geological formation 132 based on the reservoir properties. The computing device 112 is configured to calculate an actual fracture surface area ($A_{Ca}$) of the horizontal fracture field. The computing device 112 is configured to export production data from a predetermined stimulated area of the simulation reservoir and conduct a rate transient analysis (RTA) of the production data to estimate an effective stimulated fracture surface area ($A_{Ce}$) for a given number of periodic perforations in a horizontal fracturing pipe 104.

The computing device 112 is further configured to calculate a ratio of the effective fracture surface area ($A_{Ce}$) to the actual fracture surface area ($A_{Ca}$) and store the ratio of the effective fracture surface area to the actual fracture surface area for the first number of periodic perforations in a memory 114. The computing device 112 is configured to iterate the calculation of the ratio for a second number of periodic perforations, where the second number is greater than the first number by a step amount. The computing device 112 is configured to iterate the calculation of the ratio by adding the step amount to each previous number of periodic perforations until the production is less than or equal to a threshold amount. The computing device 112 is configured to build a proxy model to estimate a percentage of interference between the fractures as a function of spacing between the number of perforations and the formation properties and determine a net present value (NPV) from the proxy model. The computing device 112 is configured to estimate the number of the perforated pipe sections needed in the horizontal fracturing pipe 104 as a function of the NPV from the proxy model and the degree of interference from the RTA. The installation of the perforated sections and unperforated sections of the horizontal fracturing pipe 104 in the horizontal fracture field based on the estimated number of perforations needed to create clusters fractures in the fracture field is based on the number of perforations determined in the proxy model. Once the horizontal fracturing pipe sections are installed, the computing device 112 is configured to stimulate the horizontal fracture field by injecting a fracturing fluid 134 under pressure into the horizontal fracturing pipe 104 and recover material forced out of the fractures over the given time period.

The first embodiment is illustrated with respect to FIGS. 1-20. The first embodiment describes a horizontal fracture field system 100 for hydraulic fracturing in a shale layer 120 of a geological formation 132. The horizontal fracture field system 100 includes a borehole 102 which extends between a surface of the geological formation 132 and the shale layer 120, a tubing which extends into the borehole between a surface of the geological formation and the shale layer; a horizontal fracturing pipe 104 which extends perpendicularly from the borehole 102 into the shale layer 120, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer. The horizontal fracture field system 100 further includes a pump 106 located at the surface of the geological formation 132, and a fracturing fluid 134 configured to be injected under pressure by the pump 106 into the borehole 102 and into the horizontal fracturing pipe 104, wherein the pump is configured to inject the fracturing fluid 134 under pressure through the perforations of the stages to fracture a fracture zone in the shale layer 120. The horizontal fracture field system 100 includes a pressure sensor 108 configured to measure the pressure of the fracturing fluid 134 in the horizontal fracturing pipe 104. The horizontal fracture field system 100 also includes a fluid meter 110 located at the surface of the geological formation 132, where the fluid meter 110 is configured to measure a volume of a material forced out of the fractures by the fracturing fluid 134. The horizontal fracture field system 100 includes a computing device 112 connected to the pump 106, the pressure sensor 108, and the fluid meter 110, where the computing device 112 includes an electrical circuitry 118, a memory 114 storing program instructions and at least one processor 116 configured to execute program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an estimated fracture surface area of the horizontal fracture field and $A_{Ca}$ represents an actual fracture surface area of the horizontal fracture field; determine a net present value NPV for each spacing distance; and determine the spacing distance which minimizes the percentage of interference PI while maximizing the net present value NPV.

The material forced out of the fractures includes at least one of oil and natural gas.

The computing device 112 is configured to calculate an actual fracture surface area ($A_{Ca}$) of the horizontal fracture field, determine production data and reservoir properties of a predetermined stimulated fracture surface area of the horizontal fracture field from a pump pressure, the measurements of pressure sensor 108, and the fluid meter, export the production data and reservoir properties from the simulated reservoir at the predetermined stimulated fracture surface area, conduct a rate transient analysis (RTA) of the production data to estimate an effective fracture surface area ($A_{Ce}$) for the given number of periodic perforations, calculate a ratio of the effective fracture surface area ($A_{Ce}$) to the actual fracture surface area ($A_{Ca}$), store the ratio of the effective fracture surface area to the actual fracture surface area for the first number of periodic perforations in the memory 114, iterate the calculation of the ratio for a second number of periodic perforations, where the second number is greater than the first number by a step amount, continue to iterate the calculation of the ratio by adding the step amount to each previous number of periodic perforations until the production is less than or equal to a threshold amount, build a proxy model to estimate a percentage of interference between the fractures as a function of spacing distance between the number of perforations and the formation properties, determine a net present value (NPV) from the proxy model, and calculate the number of perforations needed in the horizontal fracturing pipe 104 as a function of the NPV from the proxy model and the degree of interference from the RTA, and actuate the pump to inject fracturing fluid through the number of perforations.

The computing device 100 is configured to calculate the NPV based on the production data, a capital cost of the fracturing, a current price of gas, and a current interest rate.

The computing device 112 is configured to build the simulated reservoir by calculating a function which includes a length of the reservoir, a thickness of the reservoir, an initial reservoir pressure, a reservoir bottom-hole pressure, a reservoir temperature, a reservoir formation porosity, and a reservoir permeability.

The computing device 112 is configured to iterate the calculation of the ratio for the number of periodic perforations ranging from 2 perforations to 20 perforations with a spacing distance ranging from 20 feet to 200 feet.

The computing device 100 is configured to conduct the RTA based on a fracture half-length which ranges from 200 feet to 400 feet.

The computing device 100 is configured to calculate the actual fracture surface area, $A_{CA}$, based on $A_{Ca}=4H_fN_fX_f$, wherein $H_f$ is a fracture height, $X_f$ is a fracture half-length, and $N_f$ is the number of perforations.

The proxy model is a random forest (RF) model, where the RF model is configured to estimate the percentage of interference based on the simulated reservoir and the RTA. The RF model is trained on production data from the RTA which is randomly split into a training data set and a testing data set, where a ratio of the training data set to the testing data set is selected from a range of 60:40 to 80:20.

The horizontal fracturing pipe 104 includes pipe sections which connect together, where each pipe section is configured as one of a pipe section with a perforation and an unperforated pipe section.

The second embodiment is illustrated with respect to FIGS. 1-20. The second embodiment describes a method for building a horizontal fracture field having low cluster interference. The method includes determining reservoir properties of a shale layer 120 of a geological formation 132 of interest, calculating, by a computing device 112 including an electrical circuitry 118, a memory 114 storing program instructions and at least one processor 116 configured to execute the program instructions, an actual fracture surface area ($A_{Ca}$) of the horizontal fracture field, exporting, by the computing device 112, production data from a predetermined stimulated area of the simulation reservoir, conducting, by the computing device 112, a rate transient analysis (RTA) of the production data to estimate an effective stimulated fracture surface area ($A_{Ce}$) for a given number of periodic perforations in a horizontal fracturing pipe 104, calculating, by the computing device 112, a ratio of the effective fracture surface area ($A_{Ce}$) to the actual fracture surface area ($A_{Ca}$), storing, in the memory 114 of the computing device 112, the ratio of the effective fracture surface area to the actual fracture surface area for the first number of periodic perforations, iterating, by the computing device 112, the calculation of the ratio for a second number of periodic perforations, where the second number is greater than the first number by a step amount, continuing, by the computing device 112, to iterate the calculation of the ratio by adding the step amount to each previous number of periodic perforations until the production is less than or equal to a threshold amount, building, by the computing device 112, a proxy model to estimate a percentage of interference between the fractures as a function of spacing distance between the number of perforations and the formation properties, determining, by the computing device 112, a net present value (NPV) from the proxy model, estimating, by the computing device 112, the number of perforations which maximizes the NPV from the proxy model while minimizing the percentage of interference PI from the RTA; installing perforated sections and unperforated sections of the horizontal fracturing pipe in the horizontal fracture field based on the estimated number of perforations; and stimulating the horizontal fracture field by injecting a fracturing fluid under pressure into the horizontal fracturing pipe through the number of perforations. The material forced out of the fractures comprises at least one of oil and natural gas.

The computing device 112 is configured to calculate the percentage of interference (PI) based on Equation (5).

The computing device 112 is configured to calculate the actual fracture surface area, $A_{CA}$, based on Equation (1).

The proxy model is a random forest (RF) model, and the method comprises training the RF model on production data from the RTA which is randomly split into a training data set and a testing data set, where a ratio of the training data set to the testing data set is selected from a range of 60:40 to 80:20 and estimating the percentage of interference based on the simulated reservoir and the RTA.

The method includes running, by the RF model, a Monte Carlo sensitivity analysis on an effect of formation properties and fracture spacing distance on an interference between the fractures, where the porosity is ranged from 2% and 10%, the fracture spacing is varied from 20 to 200 ft, and the permeability is varied from 50 to 5000 nanoDarcies (nD).

Conducting, by the computing device 112, the RTA further includes converting a bottom-hole pressure to a pseudo bottom-hole pressure and normalizing a pseudo-pressure difference between the pseudo bottom-hole pressure and the bottom-hole pressure via a gas production rate of the well.

The third embodiment is illustrated with respect to FIGS. 1-20. The third embodiment describes a method for hydraulic fracturing in a shale layer 120 of a geological formation 132. The method includes installing a tubing in a borehole 102 which extends between a surface of the geological formation 132 and the shale layer 120, installing sections of horizontal fracturing pipe 104 which extend perpendicularly from the borehole 102 into the shale layer 120, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer, installing the tubing in the horizontal fracturing pipe, installing a pump 106 at the surface of the geological formation 132, where the pump 106 is configured to inject a fracturing fluid 134 under pressure into the borehole 102 and into the horizontal fracturing pipe 104, where the pressure of the fracturing fluid 134 is configured to inject the fracturing fluid 134 through the perforations and stimulate fractures in the shale layer 120, installing a pressure sensor 108 configured to measure the pressure of the fracturing fluid 134, installing a fluid meter at the surface of the geological formation 132, where the fluid meter is configured to measure a volume of a material forced out of the fractures by the fracturing fluid 134, where the material is one or more of oil and natural gas, connecting a computing device 112 to the pump 106, the pressure sensor 108, and the fluid meter, where the computing device 112 includes an electrical circuitry 118, a memory 114 storing program instructions and at least one processor 116 configured to execute the program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an estimated fracture surface area of the horizontal fracture field and $A_{Ca}$ represents an actual fracture surface area of the horizontal fracture field; determining a net present value NPV for each spacing distance; and determining the spacing distance which minimizes the percentage of interference PI while maximizing the net present value NPV.

The method further comprises calculating, by the computing device 112, an actual fracture surface area ($A_{Ca}$) of the horizontal fracture field, exporting, by the computing device 112, production data from a predetermined stimulated area of the simulation reservoir, conducting, by the computing device 112, a rate transient analysis (RTA) of the production data to estimate an effective stimulated fracture surface area ($A_{Ce}$) for a first number of periodic perforations in a horizontal fracturing pipe 104, calculating, by the computing device 112, a ratio of the effective fracture surface area ($A_{Ce}$) to the actual fracture surface area ($A_{Ca}$), storing, in the memory 114 of the computing device 112, the ratio of the effective fracture surface area to the actual fracture surface area for the first number of periodic perforations, iterating, by the computing device 112, the calculation of the ratio for a second number of periodic perforations, where the second number is greater than the first number by a step amount, continuing, by the computing device 112, to iterate the calculation of the ratio by adding the step amount to each previous number of periodic perforations until the production is less than or equal to a threshold amount, building, by the computing device 112, a proxy model to estimate a percentage of interference between the fractures as a function of spacing between the number of perforations and the formation properties, determining, by the computing device 112, a net present value (NPV) from the proxy model, and estimating, by the computing device 112, the number of the perforated pipe sections needed in the horizontal fracturing pipe 104 as a function of the NPV from the proxy model and the degree of interference from the RTA, installing the perforated sections and unperforated sections of the horizontal fracturing pipe 104 in the horizontal fracture field based on the estimated number of perforations needed to create clusters fractures in the fracture field, stimulating the horizontal fracture field by injecting a fracturing fluid 134 under pressure into the horizontal fracturing pipe 104.

Figure 21:
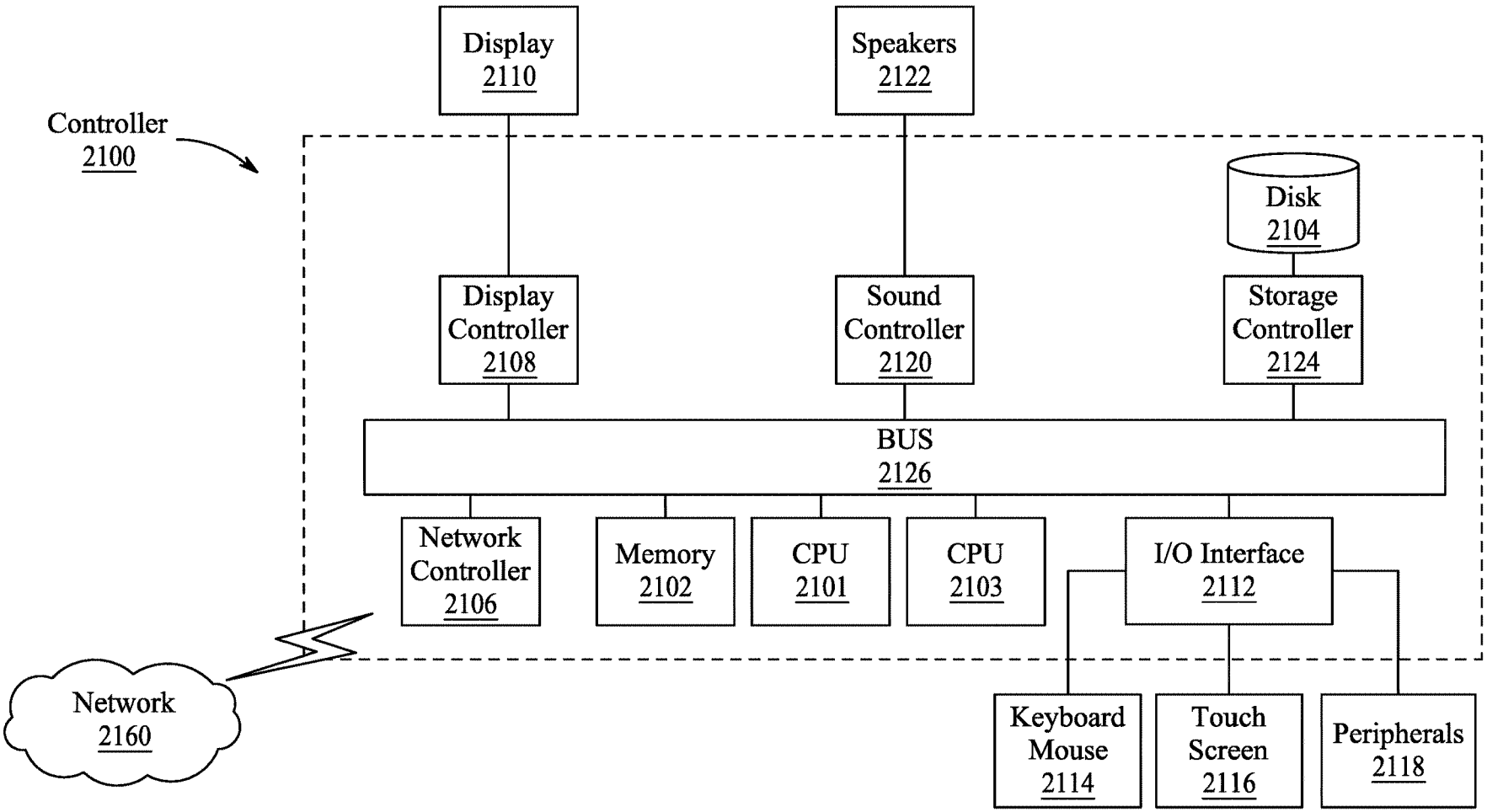
FIG. 21 is an illustration of a non-limiting example of details of computing hardware used in the computing device.

FIG. 21 is an illustration of a non-limiting example of details of computing hardware used in the computing device, according to exemplary aspects of the present disclosure. In FIG. 21, a controller 2100 is described which is a computing device (for example, the computing device 112) and includes a CPU 2100 which performs the processes described above/below. The process data and instructions may be stored in memory 2102. These processes and instructions may also be stored on a storage medium disk 2104 such as a hard drive (HDD) or portable storage medium or may be stored remotely.

Further, the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computing device communicates, such as a server or computer.

Further, the claims may be provided as a utility application, background daemon, or component of an operating system, or combination thereof, executing in conjunction with CPU 2101, 2103 and an operating system such as Microsoft Windows 7, Microsoft Windows 10, Microsoft Windows 11, UNIX, Solaris, LINUX, Apple MAC-OS and other systems known to those skilled in the art.

The hardware elements in order to achieve the computing device may be realized by various circuitry elements, known to those skilled in the art. For example, CPU 2101 or CPU 2103 may be a Xenon or Core processor from Intel of America or an Opteron processor from AMD of America or may be other processor types that would be recognized by one of ordinary skill in the art. Alternatively, the CPU 2101, 2103 may be implemented on an FPGA, ASIC, PLD or using discrete logic circuits, as one of ordinary skill in the art would recognize. Further, CPU 2101, 2103 may be implemented as multiple processors cooperatively working in parallel to perform the instructions of the inventive processes described above.

The computing device in FIG. 21 also includes a network controller 2106, such as an Intel Ethernet PRO network interface card from Intel Corporation of America, for interfacing with network 2160. As can be appreciated, the network 2160 can be a public network, such as the Internet, or a private network such as an LAN or WAN network, or any combination thereof and can also include PSTN or ISDN sub-networks. The network 2160 can also be wired, such as an Ethernet network, or can be wireless such as a cellular network including EDGE, 3G, 4G and 5G wireless cellular systems. The wireless network can also be WiFi, Bluetooth, or any other wireless form of communication that is known.

The computing device further includes a display controller 2108, such as a NVIDIA GeForce GTX or Quadro graphics adaptor from NVIDIA Corporation of America for interfacing with display 2110, such as a Hewlett Packard HPL2445w LCD monitor. A general purpose I/O interface 2112 interfaces with a keyboard and/or mouse 2114 as well as a touch screen panel 2116 on or separate from display 2110. General purpose I/O interface also connects to a variety of peripherals 2118 including printers and scanners, such as an OfficeJet or DeskJet from Hewlett Packard.

A sound controller 2120 is also provided in the computing device such as Sound Blaster X-Fi Titanium from Creative, to interface with speakers/microphone 2122 thereby providing sounds and/or music. The general purpose storage controller 2124 connects the storage medium disk 2104 with communication bus 2126, which may be an ISA, EISA, VESA, PCI, or similar, for interconnecting all of the components of the computing device. A description of the general features and functionality of the display 2110, keyboard and/or mouse 2114, as well as the display controller 2108, storage controller 2124, network controller 2106, sound controller 2120, and general purpose I/O interface 2112 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset, as shown on FIG. 22.

Figure 22:
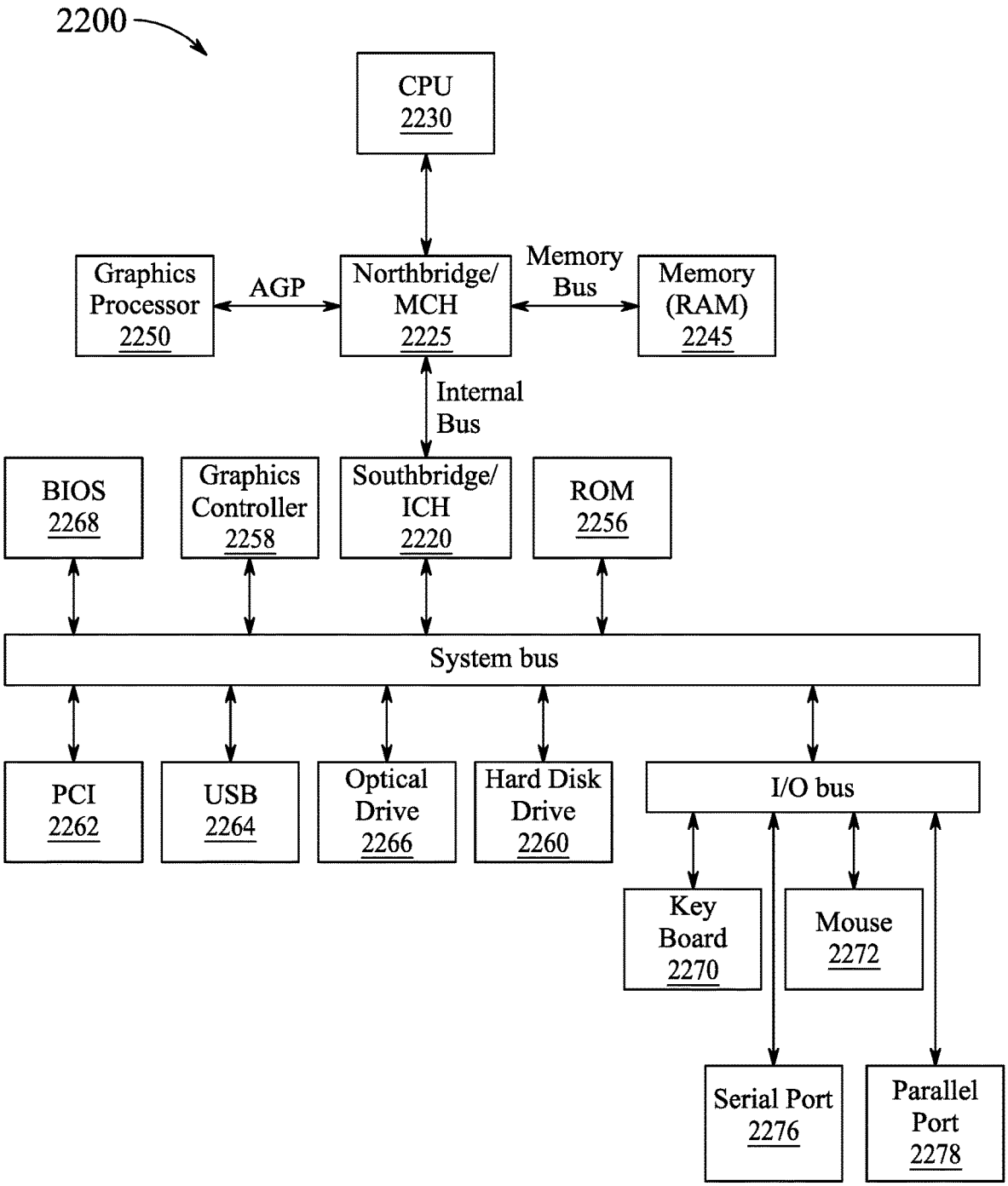
FIG. 22 is an exemplary schematic diagram of a data processing system used within the computing device.

FIG. 22 shows a schematic diagram of a data processing system 2200 for performing the functions of the exemplary embodiments. The data processing system 2200 is an example of a computer in which code or instructions implementing the processes of the illustrative embodiments may be located.

In FIG. 22, data processing system 2200 employs a hub architecture including a north bridge and memory controller hub (NB/MCH) 2225 and a south bridge and input/output (I/O) controller hub (SB/ICH) 2220. The central processing unit (CPU) 2230 is connected to NB/MCH 2225. The NB/MCH 2225 also connects to the memory 2245 via a memory bus, and connects to the graphics processor 2250 via an accelerated graphics port (AGP). The NB/MCH 2225 also connects to the SB/ICH 2220 via an internal bus (e.g., a unified media interface or a direct media interface). The CPU Processing unit 2230 may contain one or more processors and even may be implemented using one or more heterogeneous processor systems.

Figure 23:
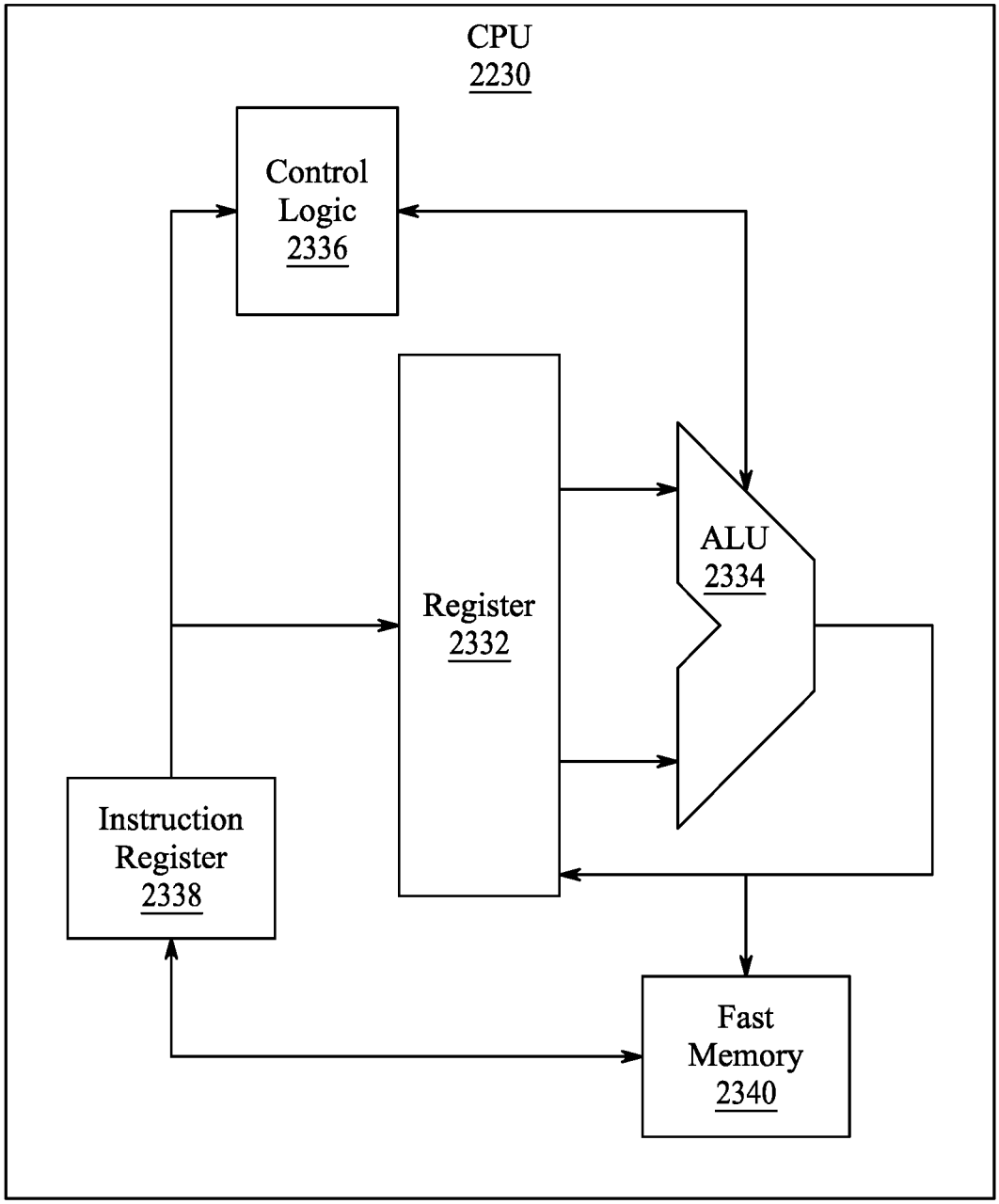
FIG. 23 is an exemplary schematic diagram of a processor used with the computing device.

For example, FIG. 23 shows one implementation of CPU 2230. In one implementation, the instruction register 2338 retrieves instructions from the fast memory 2340. At least part of these instructions are fetched from the instruction register 2338 by the control logic 2336 and interpreted according to the instruction set architecture of the CPU 2230. Part of the instructions can also be directed to the register 2332. In one implementation, the instructions are decoded according to a hardwired method, and in another implementation, the instructions are decoded according to a microprogram that translates instructions into sets of CPU configuration signals that are applied sequentially over multiple clock pulses. After fetching and decoding the instructions, the instructions are executed using the arithmetic logic unit (ALU) 2334 that loads values from the register 2332 and performs logical and mathematical operations on the loaded values according to the instructions. The results from these operations can be feedback into the register and/or stored in the fast memory 2340. The instruction set architecture of the CPU 2230 can use a reduced instruction set architecture, a complex instruction set architecture, a vector processor architecture, a very large instruction word architecture. Furthermore, the CPU 2230 can be based on the Von Neuman model or the Harvard model. The CPU 2230 can be a digital signal processor, an FPGA, an ASIC, a PLA, a PLD, or a CPLD. Further, the CPU 2230 can be an x86 processor by Intel or by AMD; an ARM processor, a Power architecture processor by, e.g., IBM; a SPARC architecture processor by Sun Microsystems or by Oracle; or other known CPU architecture.

Referring again to FIG. 23, the data processing system 2200 can include that the SB/ICH 2220 is coupled through a system bus to an I/O Bus, a read only memory (ROM) 2256, universal serial bus (USB) port 2264, a flash binary input/output system (BIOS) 2268, and a graphics controller 2258. PCI/PCIe devices can also be coupled to SB/ICH 2220 through a PCI bus 2262.

The PCI devices may include, for example, Ethernet adapters, add-in cards, and PC cards for notebook computers. The Hard disk drive 2260 and CD-ROM 2256 can use, for example, an integrated drive electronics (IDE) or serial advanced technology attachment (SATA) interface. In one implementation, the I/O bus can include a super I/O (SIO) device.

Further, the hard disk drive (HDD) 2260 and optical drive 2266 can also be coupled to the SB/ICH 2220 through a system bus. In one implementation, a keyboard 2270, a mouse 2272, a parallel port 2278, and a serial port 2276 can be connected to the system bus through the I/O bus. Other peripherals and devices that can be connected to the SB/ICH 2220 using a mass storage controller such as SATA or PATA, an Ethernet port, an ISA bus, a LPC bridge, SMBus, a DMA controller, and an Audio Codec.

Moreover, the present disclosure is not limited to the specific circuit elements described herein, nor is the present disclosure limited to the specific sizing and classification of these elements. For example, the skilled artisan will appreciate that the circuitry described herein may be adapted based on changes on battery sizing and chemistry or based on the requirements of the intended back-up load to be powered.

The functions and features described herein may also be executed by various distributed components of a system. For example, one or more processors may execute these system functions, wherein the processors are distributed across multiple components communicating in a network. The distributed components may include one or more client and server machines, which may share processing, as shown by FIG. 24, in addition to various human interface and communication devices (e.g., display monitors, smart phones, tablets, personal digital assistants (PDAs)).

Figure 24:
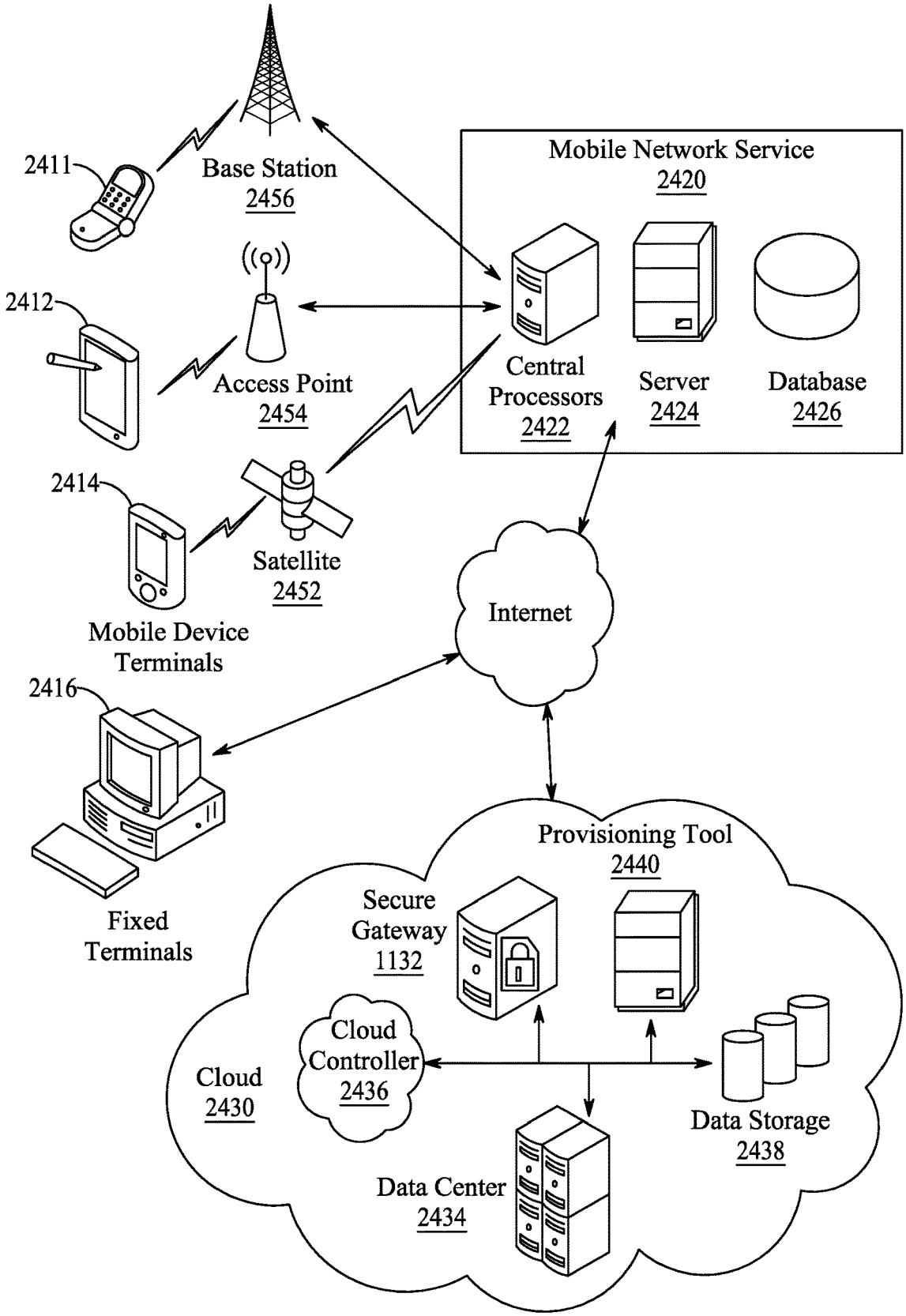
FIG. 24 is an illustration of a non-limiting example of distributed components which may share processing with the controller.

More specifically, FIG. 24 illustrates client devices including a smart phone 2411, a tablet 2412, a mobile device terminal 2414 and fixed terminals 2416. These client devices may be commutatively coupled with a mobile network service 2420 via base station 2456, access point 2454, satellite 2452 or via an internet connection. Mobile network service 2420 may comprise central processors 2422, a server 2424 and a database 2426. Fixed terminals 2416 and mobile network service 2420 may be commutatively coupled via an internet connection to functions in cloud 2430 that may comprise security gateway 2432, data center 2434, cloud controller 2436, data storage 2438 and provisioning tool 2440. The network may be a private network, such as a LAN or WAN, or may be a public network, such as the Internet. Input to the system may be received via direct user input and received remotely either in real-time or as a batch process. Additionally, some implementations may be performed on modules or hardware not identical to those described. Accordingly, other implementations are within the scope that may be claimed.

The above-described hardware description is a non-limiting example of corresponding structure for performing the functionality described herein.

Numerous modifications and variations of the present disclosure are possible in light of the above teachings. It is therefore to be understood that within the scope of the appended claims, the invention may be practiced otherwise than as specifically described herein.

The invention claimed is:

1. A horizontal fracture field system for hydraulic fracturing in a shale layer of a geological formation, comprising:

a tubing which extends into a borehole between a surface of the geological formation and the shale layer;

a horizontal fracturing pipe which extends perpendicularly from the borehole into the shale layer, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer, wherein the tubing extends through the horizontal fracturing pipe;

a pump located at the surface of the geological formation;

a fracturing fluid configured to be injected under pressure by the pump into the tubing and into the horizontal fracturing pipe, wherein the pump is configured to inject the fracturing fluid under pressure through the perforations of the stages to fracture a fracture zone in the shale layer;

a pressure sensor configured to measure the pressure of the fracturing fluid in the horizontal fracturing pipe;

a fluid meter configured to measure a volume of the fracturing fluid injected into the horizontal fracturing pipe or a volume of a material forced out of the borehole by the fracturing fluid; and a computing device connected to the pump, the pressure sensor and the fluid meter, wherein the computing device includes electrical circuitry, a memory storing program instructions and at least one processor configured to execute program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an effective fracture surface area of the horizontal fracture field and $A_{Ca}$ represents an actual fracture surface area of the horizontal fracture field;

determine a net present value NPV for each spacing distance; and determine the spacing distance which minimizes the percentage of interference PI while maximizing the net present value NPV.

2. The horizontal fracture field system of claim 1, wherein the material forced out of the fractures comprises at least one of oil and natural gas.

3. The horizontal fracture field system of claim 2, wherein the computing device is configured to:

calculate the actual fracture surface area $A_{Ca}$ of the horizontal fracture field from a reservoir model;

determine production data and reservoir properties of a predetermined stimulated fracture surface area of the horizontal fracture field from a pump pressure, the measurements of pressure sensor and the fluid meter;

export the production data and reservoir properties from the predetermined stimulated fracture surface area;

conduct a rate transient analysis (RTA) of the production data to estimate the effective fracture surface area $A_{Ce}$ for a given number of periodic perforations;

calculate a ratio of the effective fracture surface area ($A_{Ce}$) to the actual fracture surface area ($A_{Ca}$);

store the ratio of the effective fracture surface area to the actual fracture surface area for the first number of periodic perforations in the memory;

iterate the calculation of the ratio for a second number of periodic perforations, wherein the second number is greater than the first number by a step amount;

continue to iterate the calculation of the ratio by adding the step amount to each previous number of periodic perforations until the production is less than or equal to a threshold amount;

build a proxy model to estimate the percentage of interference between the fractures as a function of spacing distance between the number of perforations and the formation properties;

determine a net present value (NPV) from the proxy model;

calculate the number of perforations needed in the horizontal fracturing pipe as a function of the NPV from the proxy model and the percentage of interference from the RTA; and actuate the pump to inject fracturing fluid through the number of perforations.

4. The horizontal fracture field system of claim 3, wherein the computing device is configured to calculate the NPV based on the production data, a capital cost of the fracturing, a current price of gas, and a current interest rate.

5. The horizontal fracture field system of claim 3, wherein the computing device is configured to calculate a function which includes a length of the reservoir, a thickness of the reservoir, an initial reservoir pressure, a reservoir bottom-hole pressure, a reservoir temperature, a reservoir formation porosity, and a reservoir permeability.

6. The horizontal fracture field system of claim 3, wherein the computing device is configured to iterate the calculation of the ratio for the number of periodic perforations ranging from 2 perforations to perforations with a spacing distance ranging from feet to 200 feet.

7. The horizontal fracture field system of claim 3, wherein the computing device is configured to conduct the RTA based on a fracture half-length which ranges from 200 feet to 400 feet.

8. The horizontal fracture field system of claim 3, wherein the computing device is configured to calculate the actual fracture surface area, $A_{CA}$, based on $A_{Ca}=4\ H_f N_f X_f$, wherein $H_f$ is a fracture height, $X_f$ is a fracture half-length, and $N_f$ is the number of perforations.

9. The horizontal fracture field system of claim 3, wherein the proxy model is a random forest (RF) model, wherein the RF model is configured to estimate the percentage of interference based on the simulated reservoir and the RTA.

10. The horizontal fracture field system of claim 9, wherein the RF model is trained on production data from the RTA which is randomly split into a training data set and a testing data set, wherein a ratio of the training data set to the testing data set is selected from a range of 60:40 to 80:20.

11. The horizontal fracture field system of claim 1, wherein the horizontal fracturing pipe includes pipe sections which connect together, wherein each pipe section is configured as one of a pipe section with a perforation and an unperforated pipe section.

12. A method for building a horizontal fracture field having low cluster interference, comprising:

determining reservoir properties of a shale layer of a geological formation of interest;

calculating, by a computing device including electrical circuitry, a memory storing program instructions and at least one processor configured to execute the program instructions, an actual fracture surface area ($A_{Ca}$) of the horizontal fracture field;

exporting, by the computing device, production data from a predetermined stimulated fracture surface area;

conducting, by the computing device, a rate transient analysis (RTA) of the production data to estimate an effective fracture surface area ($A_{Ce}$) for a given number of periodic perforations in a horizontal fracturing pipe;

calculating, by the computing device, a ratio of the effective fracture surface area ($A_{Ce}$) to the actual fracture surface area ($A_{Ca}$);

storing, in the memory of the computing device, the ratio of the effective fracture surface area to the actual fracture surface area for the first number of periodic perforations;

iterating, by the computing device, the calculation of the ratio for a second number of periodic perforations, wherein the second number is greater than the first number by a step amount;

continuing, by the computing device, to iterate the calculation of the ratio by adding the step amount to each previous number of periodic perforations until the production is less than or equal to a threshold amount;

building, by the computing device, a proxy model to estimate a percentage of interference PI between the fractures as a function of spacing distance between the number of perforations and the formation properties;

determining, by the computing device, a net present value (NPV) from the proxy model;

estimating, by the computing device, the number of perforations which maximizes the NPV from the proxy model while minimizing the percentage of interference PI from the RTA;

installing perforated sections and unperforated sections of the horizontal fracturing pipe in the horizontal fracture field based on the estimated number of perforations; and stimulating the horizontal fracture field by injecting a fracturing fluid under pressure into the horizontal fracturing pipe through the number of perforations.

13. The method of claim 12, wherein the material forced out of the fractures comprises at least one of oil and natural gas.

14. The method of claim 13, wherein the computing device is configured to calculate the percentage of interference PI based on: $PI=100\ (1-A_{Ce}/A_{Ca})$.

15. The method of claim 14, wherein the computing device is configured to calculate the actual fracture surface area, $A_{CA}$, based on $A_{Ca}=4\ H_f N_f X_f$, wherein $H_f$ is a fracture height, $X_f$ is a fracture half-length, and $N_f$ is the number of perforations.

16. The method of claim 15, wherein the proxy model is a random forest (RF) model, comprising:

training the RF model on production data from the RTA which is randomly split into a training data set and a testing data set, wherein a ratio of the training data set to the testing data set is selected from a range of 60:40 to 80:20; and estimating the number of perforations based on the percentage of interference PI and the RTA.

17. The method of claim 16, comprising:

running, by the RF model, a Monte Carlo sensitivity analysis on an effect of formation properties and fracture spacing distance on an interference between the fractures, wherein the porosity is ranged from 2% and 10%, the fracture spacing is varied from to 200 ft, and the permeability is varied from 50 to 5000 nanoDarcies (nD).

18. The method of claim 16, wherein:

conducting, by the computing device, the RTA, further includes converting a bottom-hole pressure to a pseudo bottom-hole pressure; and normalizing a pseudo-pressure difference between the pseudo bottom-hole pressure and the bottom-hole pressure via a gas production rate of the well.

19. A method for hydraulic fracturing in a shale layer of a geological formation, comprising:

installing a tubing in a borehole which extends between a surface of the geological formation and the shale layer;

installing a horizontal fracturing pipe which extends perpendicularly from the borehole into the shale layer, wherein the horizontal fracturing pipe has a number of stages, each stage having at least one perforation, wherein the at least one perforation of a first stage is separated by a spacing distance from at least one perforation of a neighboring stage, wherein each spacing distance corresponds with a fracture zone in the shale layer;

installing the tubing in the horizontal fracturing pipe;

installing a pump at the surface of the geological formation, wherein the pump is configured to inject a fracturing fluid under pressure into the tubing, wherein the pressure of the fracturing fluid is configured to inject the fracturing fluid through the perforations and stimulate fractures in the shale layer;

installing a pressure sensor at the surface of the geological formation, wherein the pressure sensor is configured to measure the pressure of the fracturing fluid;

installing a fluid meter at the surface of the geological formation, wherein the fluid meter is configured to measure a volume of the fracturing fluid injected into the horizontal fracturing pipe or a volume of a material forced out of the borehole by the fracturing fluid, wherein the material is one or more of oil and natural gas;

connecting a computing device to the pump, the pressure sensor and the water meter, wherein the computing device includes electrical circuitry, a memory storing program instructions and at least one processor configured to execute the program instructions to estimate a percentage of interference PI between fracture zones of neighboring stages, according to the formula:

$$PI = 100 * \left(1 - \frac{A_{Ce}}{A_{Ca}}\right),$$

where $A_{Ce}$ represents an effective fracture surface area of the horizontal fracture field and $A_{Ca}$ represents an actual fracture surface area of the horizontal fracture field;

determining a net present value NPV for each spacing distance; and determining the spacing distance which minimizes the percentage of interference PI while maximizing the net present value NPV.

20. The method of claim 19, further comprising:

calculating, by the computing device, the actual fracture surface area ($A_{Ca}$) of the horizontal fracture field;

exporting, by the computing device, production data from a predetermined stimulated area of the simulation reservoir;

conducting, by the computing device, a rate transient analysis (RTA) of the production data to estimate the effective fracture surface area ($A_{Ce}$) for a first number of periodic perforations in a horizontal fracturing pipe;

calculating, by the computing device, a ratio of the effective fracture surface area ($A_{Ce}$) to the actual fracture surface area ($A_{Ca}$);

storing, in the memory of the computing device, the ratio of the effective fracture surface area to the actual fracture surface area for the first number of periodic perforations;

iterating, by the computing device, the calculation of the ratio for a second number of periodic perforations, wherein the second number is greater than the first number by a step amount;

continuing, by the computing device, to iterate the calculation of the ratio by adding the step amount to each previous number of periodic perforations until the production is less than or equal to a threshold amount;

building, by the computing device, a proxy model to estimate a percentage of interference between the fractures as a function of spacing distance between the number of perforations and the formation properties;

determining, by the computing device, a net present value (NPV) from the proxy model;

estimating, by the computing device, the number of the perforated pipe sections needed in the horizontal fracturing pipe as a function of the NPV from the proxy model and the percentage of interference from the RTA;

installing the perforated sections and unperforated sections of the horizontal fracturing pipe in the horizontal fracture field based on the estimated number of perforations; and stimulating the horizontal fracture field by injecting a fracturing fluid under pressure into the horizontal fracturing pipe.

* * * * *